US006810663B2

(12) United States Patent
Konishi et al.

(10) Patent No.: US 6,810,663 B2
(45) Date of Patent: Nov. 2, 2004

(54) FLUID PRESSURE CIRCUIT CONTROL SYSTEM

(75) Inventors: Hideo Konishi, Tokyo (JP); Seiichi Akiyama, Tokyo (JP); Masayuki Tanaka, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 13 days.

(21) Appl. No.: 10/344,087

(22) PCT Filed: Mar. 28, 2002

(86) PCT No.: PCT/JP02/03064

§ 371 (c)(1),
(2), (4) Date: Feb. 7, 2003

(87) PCT Pub. No.: WO02/093017

PCT Pub. Date: Nov. 21, 2002

(65) Prior Publication Data

US 2003/0172650 A1 Sep. 18, 2003

(30) Foreign Application Priority Data

May 15, 2001 (JP) ..... 2001-144548

(51) Int. Cl.[7] ..... E02F 9/22

(52) U.S. Cl. ..... 60/421; 60/422; 60/429; 60/430

(58) Field of Search ..... 60/421, 422, 428, 60/429, 430, 484, 486

(56) References Cited

U.S. PATENT DOCUMENTS 5,829,252 A * 11/1998 Hirata et al. ..... 60/421

FOREIGN PATENT DOCUMENTS

| | | | |
|---|---|---|---|
| JP | 58-153831 | 9/1983 | ..... E02F/9/22 |
| JP | 03-268004 | 11/1991 | ..... G05B/15/02 |
| JP | 05-033774 | 2/1993 | ..... F04B/49/00 |
| JP | 05-280501 | 10/1993 | ..... F16B/11/00 |

* cited by examiner

*Primary Examiner*—Thomas E. Lazo
(74) *Attorney, Agent, or Firm*—Darby & Darby

(57) ABSTRACT

Hydraulic oil supplied from pumps (12),(13) to an attachment actuator (60) is controlled by attachment control valves (27),(28). Hydraulic oil supplied from pumps (12),(13) to other actuators (52),(54),(56),(58) is controlled by other control valves (21) through (26). Control conditions for operating the attachment actuator (60) alone and control conditions for operating the attachment actuator (60) simultaneously with any of the other actuators (52),(54),(56),(58) are discriminated by the pilot pressure sensors (32),(34),(36),(38). Control characteristics of the attachment control valves (27),(28) are controlled by a controller (43) based on the discriminated control conditions.

6 Claims, 39 Drawing Sheets

P1=P2=P3=0 (TABLE 1-1)

(a)

(b)

P1>0, P2=P3=0 (TABLE 1-2)

(a)

(b)

P1=0, P2>0, P3=0 (TABLE 1-3)

(a)

(b)

P1=0,P2=0,P3>0 (TABLE 1-4)

(a)

(b)

P1>0,P2>0,P3=0 (TABLE 1-5)

(a)

(b)

P1>0, P2=0, P3>0 (TABLE 1-6)

(a)

(b)

P1=0,P2>0,P3>0 (TABLE 1-7)

(a)

(b)

P1>0,P2>0,P3>0 (TABLE 1-8)

(a)

(b)

P1=P2=P3=0 (TABLE 2-1)

(a)

(b)

P1>0,P2=P3=0 (TABLE 2-2)

(a)

(b)

P1=0, P2>0, P3=0 (TABLE 2-3)

(a)

(b)

P1=0,P2=0,P3>0 (TABLE 2-4)

(a)

(b)

P1>0,P2>0,P3=0 (TABLE 2-5)

(a)

(b)

P1>0,P2=0,P3>0 (TABLE 2-6)

(a)

(b)

P1=0,P2>0,P3>0 (TABLE 2-7)

(a)

(b)

P1>0,P2>0,P3>0 (TABLE 2-8)

(a)

(b)

P1=P2=P3=0 (TABLE 3-1)

(a)

(b)

P1>0, P2=P3=0 (TABLE 3-2)

(a)

(b)

P1=0,P2>0,P3=0 (TABLE 3-3)

(a)

(b)

P1=P2=0,P3>0 (TABLE 3-4)

(a)

(b)

P1>0,P2>0,P3=0 (TABLE 3-5)

(a)

(b)

P1>0, P2=0, P3>0 (TABLE 3-6)

(a)

(b)

P1=0,P2>0,P3>0 (TABLE 3-7)

(a)

(b)

P1>0,P2>0,P3>0 (TABLE 3-8)

(a)

(b)

P1=P2=P3=0 (TABLE 4-1)

(a)

(b)

P1>0, P2=P3=0 (TABLE 4-2)

(a)

(b)

P1=0, P2>0, P3=0 (TABLE 4-3)

(a)

(b)

P1=P2=0,P3>0 (TABLE 4-4)

(a)

(b)

P1>0,P2>0,P3=0 (TABLE 4-5)

(a)

(b)

P1>0,P2=0,P3>0 (TABLE 4-6)

(a)

(b)

P1=0,P2>0,P3>0 (TABLE 4-7)

(a)

(b)

P1>0,P2>0,P3>0 (TABLE 4-8)

(a)

(b)

FLUID PRESSURE CIRCUIT CONTROL SYSTEM

This is a U.S. national phase application under 35 U.S.C. §371 of International Patent Application No. PCT/JP02/03064, filed Mar. 28, 2002, and claims the benefit of Japanese Patent Application No. 2001-144548, filed May 15, 2001. The international Application was published in Japanese on Nov. 21, 2002 as WO 02/093017 A1 under PCT Article 21(2).

TECHNICAL FIELD

The present invention relates to a control system for a hydraulic circuit for operating a plurality of actuators simultaneously.

BACKGROUND OF THE INVENTION

As shown in FIG. 39, a hydraulic excavator, which is a construction machine, has an undercarriage 51 and an upper structure 53, which is mounted on the undercarriage 51 and adapted to be rotated by a turning actuator 52. The base end of a boom 55, which is adapted to be swung by boom actuators 54, is secured to the upper structure 53 by a shaft. The base end of a stick 57, which is adapted to be swung by a stick actuator 56, is secured to the fore end of the boom 55 by a shaft. An attachment 59 or a bucket, either of which is adapted to be pivoted by a bucket actuator 58, is secured to the fore end of the stick 57 by a shaft. The attachment 59 is a working tool to be operated by an attachment actuator 60.

Such a hydraulic excavator as described above is provided with two pumps so that hydraulic pressures and flow rates are supplied to the actuators 52,54,56,58,60 through parallel passages by control valves that are connected to the two pumps.

Some of these actuators 52,54,56,58,60 operate by confluent flows of hydraulic oil from the two pumps, while there are those that operate solely by hydraulic oil supplied from either pump.

In the case of a hydraulic excavator, the boom actuators 54, the stick actuator 56, and the attachment actuator 60 operate by confluent flows of hydraulic oil from the two pumps. Examples of the actuators that operate solely by hydraulic oil supplied from either pump include the turning actuator 52 and the bucket actuator 58.

The attachment actuator 60, which requires a high flow rate exceeding the delivery rate of a single pump, must be driven by joining the flows of hydraulic oil from both pumps.

When operating the attachment actuator 60, which has a feature described above, simultaneously with an actuator of a 2-pump confluent type, such as the boom actuators 54 or the stick actuator 56, there arises a problem characteristic to parallel connection of actuators; the hydraulic oil tends to concentrate in the actuator with the lowest working pressure, thereby drastically slowing operation of the other actuators.

For example, when using an open/close breaker or the like as the attachment 59, the working pressure for the attachment actuator 60 to open or close the breaker is lower than the working pressure for the boom actuators 54 or the stick actuator 56 to raise the boom 55 or the stick 57. Therefore, when an operating device is operated to raise the boom 55 and/or the stick 57 while opening or closing the attachment 59, neither the boom actuators 54 nor the stick actuator 56 is actuated until the attachment actuator 60 with the lower working pressure reaches the end of its stroke. It is thus difficult to operate these actuators in optimal synchronization.

In order to solve the above problem, an object of the present invention is to improve the function of the machine when operating a specific actuator which requires a high flow rate simultaneously with other actuators.

DISCLOSURE OF THE INVENTION

A hydraulic circuit control system according to the invention includes one or more specific control valves for controlling hydraulic fluid supplied from one or more pumps to a specific actuator, one or more other control valves for controlling hydraulic fluid supplied from said pump(s) to one or more other actuators, discriminating means for distinguishing between control conditions for operating said specific actuator alone and control conditions for operating the same simultaneously with any of the other actuators, and a controller for controlling control characteristics of the specific control valve(s) based on discriminated control conditions.

With the configuration as above, the discriminating means is capable of distinguishing the mode of operating the specific actuator by hydraulic fluid supplied from the pump (s) between operating it alone and operating it simultaneously with any of the other actuators. Therefore, when the specific actuator is operated in the combined operation mode, the specific control valve(s) and the other control valve(s) are controlled to effect optimal balance between these valves so that combined operatability of the specific actuator and the other actuator(s) is improved. When the specific actuator is operated alone, a high flow rate required by the specific actuator is ensured.

A hydraulic circuit control system according to another feature of the invention is characterized in that said one or more pumps are comprised of a plurality of pumps; said one or more specific control valves are comprised of a plurality of control valves respectively corresponding to said plurality of pumps; said one or more other control valves are comprised of a plurality of control valves respectively corresponding to said plurality of pumps; and that the controller has functions of storing control characteristics for each respective control valve and choosing the characteristics most suitable for the control conditions from among a plurality of control characteristics stored therein.

Therefore, upon receiving control conditions from the discriminating means, the controller is capable of controlling the specific control valves, which are respectively associated with the plural number of pumps, with the characteristics that have been selected from a plurality of control characteristics stored beforehand so as to be most suitable for the control conditions. As a result, the actuator is ensured of superior operatability in the combined operation mode and a high flow rate in the single operation mode.

A hydraulic circuit control system according to yet another feature of the invention is characterized in that two each pumps and specific control valves are provided and that the controller has such a function that when ascertaining combined operation of the specific actuator with any of the other actuators, the controller automatically adjusts control signals to be output to the two specific control valves so as to switch the source of hydraulic fluid to the specific actuator from the two pumps to either one of the two pumps according to pump-selecting criteria for the combined operation mode, which criteria have been set beforehand with respect to the other actuators.

With the configuration as above, when the specific actuator is operated together with any of the other actuators, one of the lines of the hydraulic fluid discharged from the two pumps is closed off by one of the two specific control valves, and the hydraulic fluid in the closed line is fed through the other control valves to the other actuators. Therefore, even when the specific actuator is operated at a pressure lower than that applied to the other actuators, combined operatability of the specific actuator and the other actuators can be improved.

A hydraulic circuit control system according to yet another feature of the invention is characterized in that the controller has a function of storing a plurality of control patterns consisting of a plurality of grouped control characteristics of the specific control valves and that the hydraulic circuit control system includes a control pattern selecting device for selecting from these control patterns the pattern most appropriate for the specific actuator.

When the specific actuator is replaced by an actuator of another kind, the control pattern selecting device permits the collective setting of a plurality of control characteristics by merely selecting the appropriate pattern for the kind of the specific actuator to be used. By thus eliminating the complication of re-setting control characteristics for each attachment individually, adjusting operation that is necessary when changing the specific actuators is facilitated.

The controller of a hydraulic circuit control system according to yet another feature of the invention is provided with a control pattern that includes such control characteristics as to reduce the output signal ratio with respect to the amount of operation to be input into the specific control valves when the controller ascertains combined operation and a great load being applied to the other actuators. Therefore, by reducing the output signal ratio with respect to the amount of operation to be input into the specific control valves so as to increase by the reduced amount the pressure of the hydraulic fluid applied to the other actuators that are exposed to a heavy load, combined operation of the specific actuator and the other actuators can be optimized.

The controller of a hydraulic circuit control system according to yet another feature of the invention is provided with a control characteristic overwriting device adapted to overwrite control characteristics currently stored in the controller with other control characteristics that correspond to some other actuator. Therefore, when using some other specific actuator that was not originally to be used, the control characteristic overwriting device permits the control of the hydraulic circuit with the optimal control characteristics by overwriting the control characteristics at any desired time.

According to yet another feature of the invention, the specific actuator is an attachment actuator for operating the attachment attached to the fore end of the working device of a hydraulic excavator, and the other actuators are working actuators other than the attachment actuator. Therefore, the invention is capable of improving combined operatability of the attachment actuator and the other actuators, said attachment actuator being the actuator that requires the highest flow rate among all the actuators of the working device of a hydraulic excavator. The invention also ensures the attachment actuator to be operated at the maximum speed when it is operated in the single operation mode.

The controller of a hydraulic circuit control system according to yet another feature of the invention is capable of storing a plurality of control patterns consisting of a plurality of control characteristics of the specific control valves, which characteristics are grouped in accordance with a plurality of attachments that can be interchangeably attached to the same working device, and the controller is provided with a control pattern selecting device for choosing, when the attachment is changed, a pattern appropriate for the actuator of the newly connected attachment from among these control patterns.

This feature is particularly effective in demolition or other work that must be performed while changing a plurality of attachments, because there is no need of setting or adjusting control conditions each time the attachment is changed; rather than setting or adjusting control conditions each time the attachment is changed, a plurality of control characteristics can be set collectively by choosing the control patters appropriate for the attachments to be used from among a plurality of control patterns that have been formed beforehand by grouping a plurality of control conditions. Therefore, the invention is effective in facilitating adjusting operation when changing the attachment.

PREFERRED EMBODIMENT OF THE INVENTION

Figure 1:
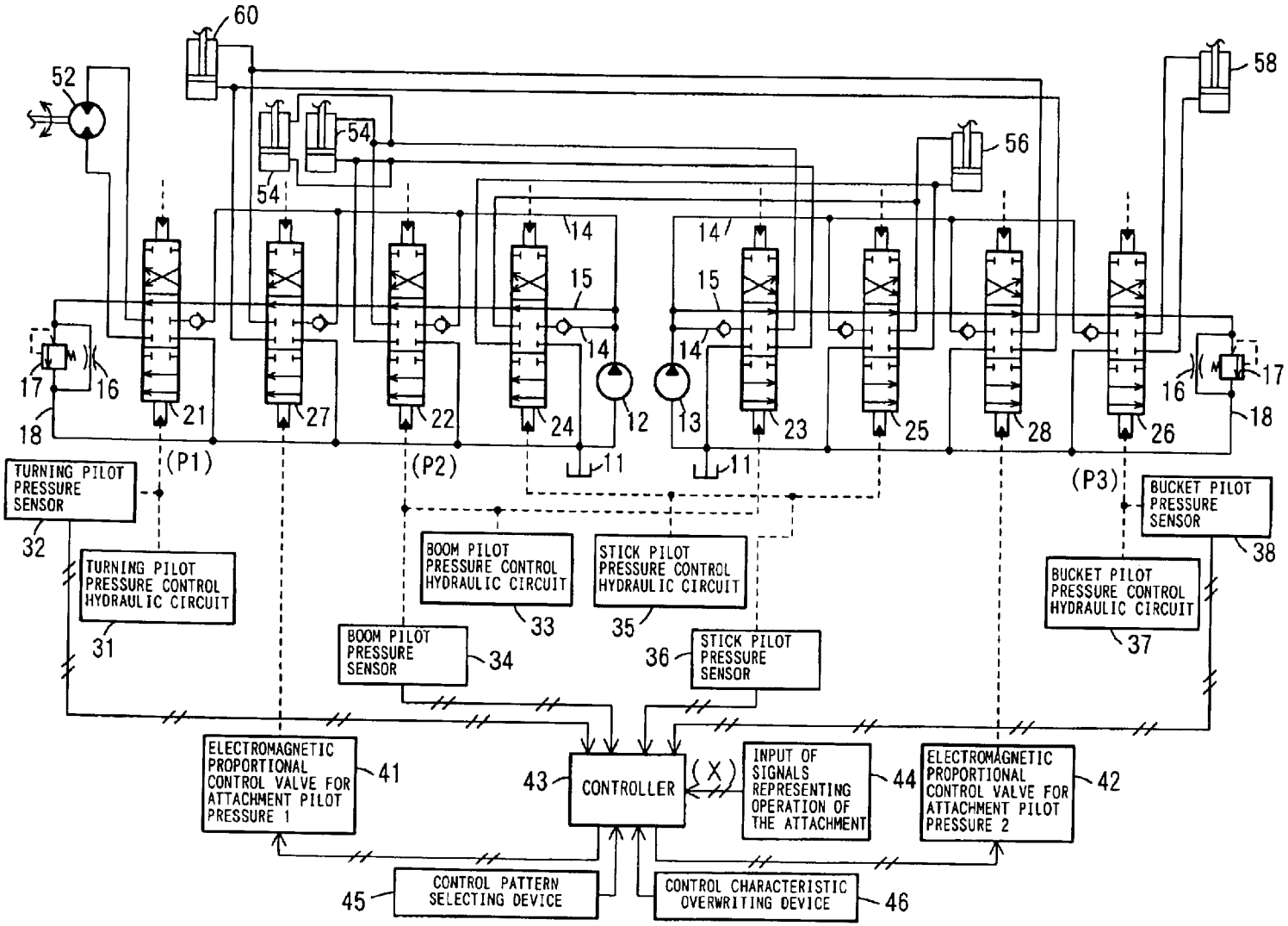
FIG. 1 is a schematic block diagram showing a hydraulic circuit control system according to the present invention.

Next, the present invention is explained in detail, referring to an embodiment thereof shown in FIGS. 1 through 38. The reference numerals with which the actuators 52,54,56,58,60 of the hydraulic excavator shown in FIG. 39 are also used in the explanation hereunder.

FIG. 1 shows a hydraulic circuit and an electronic control system for a hydraulic excavator. To explain the working principle, the illustration is simplified by omitting the drive system or the like. The intake ends of two hydraulic pumps (hereinafter simply referred to as pumps) 12,13 are connected to a tank 11. A hydraulic oil supply passage 14 and a center by-pass passage 15 are connected to the discharge end of each pump 12,13. The hydraulic oil supply passages 14 are connected to oil intake ports of control valves 21 through 28. The center by-pass passages 15 are connected via the control valves 21 through 28 to orifices 16 and relief valves 17, from which hydraulic oil flows through tank lines 18 into the tank 11. To be more specific, when the control valves connected to one of the pumps are at the neutral position, the center by-pass passage 15 connected to said pump communicates with the tank 11 via the corresponding control valves, orifice 16, relief valve 17, and tank line 18.

The control valve 21 is a pilot operated turning control valve for controlling the turning actuator 52. A pilot pressure receiving portion of the control valve 21 is connected to a turning pilot pressure control hydraulic circuit 31 adapted to control turning pilot pressure. A turning pilot pressure sensor 32 for detecting turning pilot pressure of the turning pilot pressure control hydraulic circuit 31, too, is connected to the pilot pressure receiving portion of the control valve 21.

The control valves 22,23 are pilot operated boom control valves for controlling the boom actuators 54. Pilot pressure receiving portions of the control valves 22,23 are connected to a boom pilot pressure control hydraulic circuit 33 adapted to control pilot pressure for the boom. A boom pilot pressure sensor 34 for detecting boom pilot pressure of the boom pilot pressure control hydraulic circuit 33, too, is connected to the pilot pressure receiving portions of the control valves 22,23.

The control valves 24,25 are pilot operated stick control valves for controlling the stick actuator 56. Pilot pressure receiving portions of the control valves 24,25 are connected to a stick pilot pressure control hydraulic circuit 35 adapted to control pilot pressure for the stick. A stick pilot pressure sensor 36 for detecting stick pilot pressure of the stick pilot pressure control hydraulic circuit 35, too, is connected to the pilot pressure receiving portions of the control valves 24,25.

The control valve 26 is a pilot operated bucket control valve for controlling the bucket actuator 58. A pilot pressure receiving portion of the control valve 26 is connected to a bucket pilot pressure control hydraulic circuit 37 adapted to control pilot pressure for the bucket. A bucket pilot pressure sensor 38 for detecting bucket pilot pressure of the bucket pilot pressure control hydraulic circuit 37, too, is connected to the pilot pressure receiving portion of the control valve 26.

The control valves 27,28 are pilot operated attachment control valves that serve as specific control valves for controlling a specific actuator, which is, in the case of the present embodiment, the attachment actuator 60. Electromagnetic proportional control valves 41,42 are respectively connected to pilot pressure receiving portions of the control valves 27,28. The electromagnetic proportional control valve 41 is adapted to control one line of pilot pressure for the attachment, i.e. attachment pilot pressure 1. The electromagnetic proportional control valve 42 is adapted to control another line of pilot pressure for the attachment, i.e. attachment pilot pressure 2.

The turning pilot pressure sensor 32, the boom pilot pressure sensor 34, the stick pilot pressure sensor 36, and the bucket pilot pressure sensor 38 are connected to an input section of a controller 43.

An attachment operating unit 44, too, is connected to the input section of the controller 43 so as to input electric signals corresponding to the amount of operation of the attachment. The aforementioned electromagnetic proportional control valves 41,42 are also connected to an output section of the controller 43 so that electric signals input from the attachment operating unit 44 in accordance with the amount of operation of the attachment is processed based on signals input from the various sensors and other relevant elements. The processed signals are output from the controller 43 to the electromagnetic proportional control valves 41,42. The procedure of processing signals from the attachment operating unit 44 will be described later.

In proportion to attachment pilot pressures output from the electromagnetic proportional control valves 41,42, strokes of the attachment control valves 27,28, in other words the positions of the spools of these control valves, are controlled.

As described above, the five kinds of hydraulic actuators, i.e. the turning actuator (hydraulic motor) 52, the attachment actuator (hydraulic cylinder) 60, the boom actuators (hydraulic cylinders) 54, the stick actuator (hydraulic cylinder) 56, and the bucket actuator (hydraulic cylinder) 58 arranged in this order from left to right are connected to the hydraulic circuit. The turning actuator 52 is adapted to be supplied with hydraulic pressure and flow rate from a single pump, i.e. the pump 12 at the left side. The bucket actuator 58, too, is adapted to be supplied with hydraulic pressure and flow rate from a single pump, i.e. the pump 13 at the right side. The attachment actuator 60, the boom actuators 54, and the stick actuator 56 are adapted to be supplied with hydraulic pressures and flow rates from both pumps 12,13.

The aforementioned electronic control system has five input means, two output means, and the controller 43, which is adapted to control these input and output means. The five input means consist of the turning pilot pressure sensor 32, the boom pilot pressure sensor 34, the stick pilot pressure sensor 36, and the bucket pilot pressure sensor 38. The two output means consist of the electromagnetic proportional control valve 41 for controlling the left side attachment pilot pressure 1 and the electromagnetic proportional control valve 42 for controlling the right side attachment pilot pressure 2.

The control valves 27,28 control hydraulic fluid (hydraulic oil in the case of the present embodiment) supplied from the pumps 12,13 to the attachment actuator 60. The other control valves 21 through 26 control hydraulic fluid (hydraulic oil in the case of the present embodiment) supplied from the pumps 12,13 to the other actuators 52,54, 56,58.

The turning pilot pressure sensor 32 for detecting turning pilot pressure P1, the boom pilot pressure sensor 34 for detecting boom pilot pressure P2, the stick pilot pressure sensor 36 for detecting stick pilot pressure, and the bucket pilot pressure sensor 38 for detecting bucket pilot pressure P3 are discriminating means for distinguishing between control conditions for operating the attachment actuator 60 alone and control conditions for operating it simultaneously with any of the other actuators 52,54,56,58.

As shown in FIGS. 7 through 38, a function of the controller 43 is to control the control characteristics of the control valves 27,28 according to data obtained by the discriminating mean, i.e. the aforementioned pilot pressure sensors 32,34,36,38, so that the controller 43 controls the control characteristics of the control valves 27,28 by distinguishing the mode of operation of the attachment actuator 60, which is operated by hydraulic oil fed from the pumps 12,13, between operating the attachment actuator 60 alone and operating it simultaneously with any of the other actuators 52,54,56,58.

With the function as above, when the attachment actuator 60 is operated in the combined operation mode, the controller 43 maintains optimal the balance between the control valves 27,28 and other control valves 21 through 26, thereby improving operatability of the actuator 60 and the other actuators 52,54,56,58 that are being operated simultaneously with the actuator 60. When the attachment actuator 60 is operated alone, the controller 43 ensures a high flow rate required by the attachment actuator 60.

A plurality of pumps, i.e. the pumps 12,13, are provided to correspond to the control valves 27,28 for the attachment, the control valves 22,23 for the boom, and the control valves 24,25 for the stick. For controlling turning and the bucket, one each control valve is provided: the turning control valve 21 associated with the left pump 12, and the bucket control valve 26 associated with the right pump 13. The controller 43 has functions of storing in its memory the control characteristics for each respective control valve 27,28 and selecting from a plurality of control characteristics stored in its memory the characteristics most suitable for the control conditions.

Therefore, upon receiving control conditions from the pilot pressure sensors 32,34,36,38 serving as the discriminating means, the controller 43 is capable of controlling the attachment control valves 27,28, which are respectively associated with the plural number of pumps 12,13, with the characteristics that have been selected from a plurality of control characteristics stored beforehand so as to be most suitable for the control conditions. As a result, the attachment is ensured of superior operatability in the combined operation mode and a high flow rate in the single operation mode.

In the present embodiment, two each control valves (27 and 28) and pumps (12 and 13) are provided, and the controller 43 has such a function that when ascertaining combined operation of the attachment actuator 60 with any of the other actuators 52,54,56,58, the controller 43 automatically adjusts control signals to be output through the electromagnetic proportional control valves 41,42 to the two attachment control valves 27,28 so as to switch the source of hydraulic oil to the attachment actuator 60 from both pumps 12,13 to either pump 12 or pump 13 according to pump-selecting criteria for the combined operation mode, which criteria have been set beforehand with respect to the other actuators 52,54,56,58.

With the configuration as above, when the attachment actuator 60 is operated together with any of the other actuators 52,54,56,58, one of the lines of the hydraulic oil discharged from the two pumps 12,13 is closed off by one of the two attachment control valves 27,28, and the hydraulic oil in the closed line is fed through the other control valves 21 through 26 to the other actuators 52,54,56,58. Therefore, even when the attachment actuator 60 is operated at a pressure lower than that applied to the other actuators 52,54,56,58, operatability of the attachment actuator 60 and the other actuators 52,54,56,58 that are being operated simultaneously with the actuator 60 can be improved.

The controller 43 has a function of storing a plurality of control patterns consisting of a plurality of grouped control characteristics of the attachment control valves 27,28. A control pattern selecting device 45 for selecting from these control patterns the pattern most appropriate for the attachment actuator 60 is connected to the controller 43.

The control pattern selecting device 45 is a keyboard, a keypad, a switch, or the like to be operated by an operator of the hydraulic excavator so as to select a pattern from among a plurality of control patterns stored in the memory of the controller 43.

As shown in FIGS. 2 through 6, when the attachment actuator 60 is replaced by an actuator of another kind, the control pattern selecting device 45 allows the operator to collectively set a plurality of control characteristics stored in the memory (Table 1-1 through 1-8, Table 2-1 through 2-8, Table 3-1 through 3-8, or Table 4-1 through 4-8) by merely selecting the appropriate pattern for the kind of the attachment actuator 60 to be used from among different control patterns ([Setting 1], [Setting 2], [Setting 3], and [Setting 1]). By thus eliminating the burden of re-setting control characteristics for each attachment individually, the control pattern selecting device 45 facilitates adjusting operation that is necessary when the attachment actuator 60 is changed.

The controller 43 has a control pattern that includes such control characteristics as to reduce the output signal ratio with respect to the amount of operation to be input into the attachment control valves 27,28 when the controller 43 ascertains combined operation and a great load being applied to the other actuator 52,54,56,58.

Figure 25:
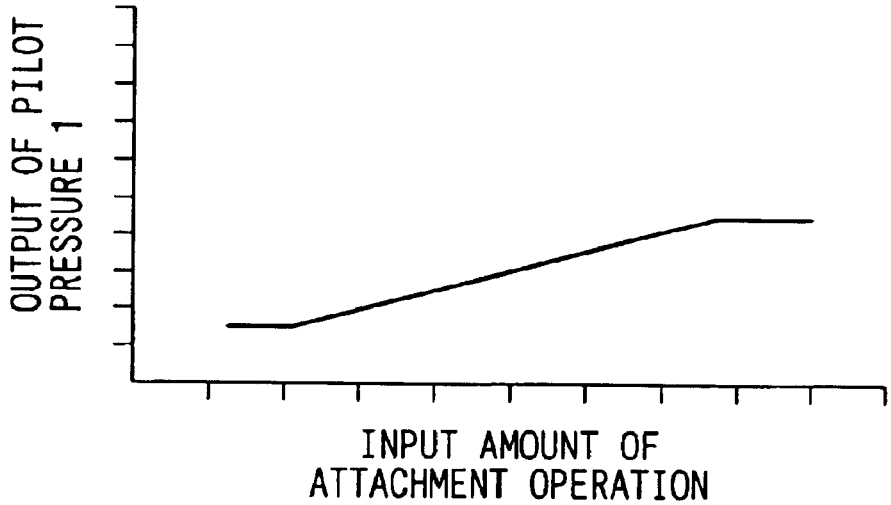
FIG. 25 is a characteristic diagram showing control characteristics to control pilot pressure output with respect to amounts of operation input to the two attachment control valves set in Table 3-3.
Figure 25:
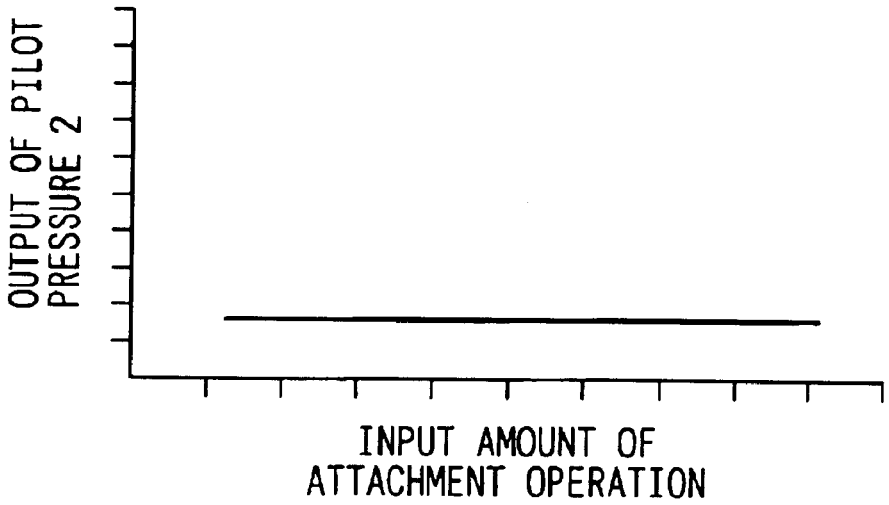
Figure 27:
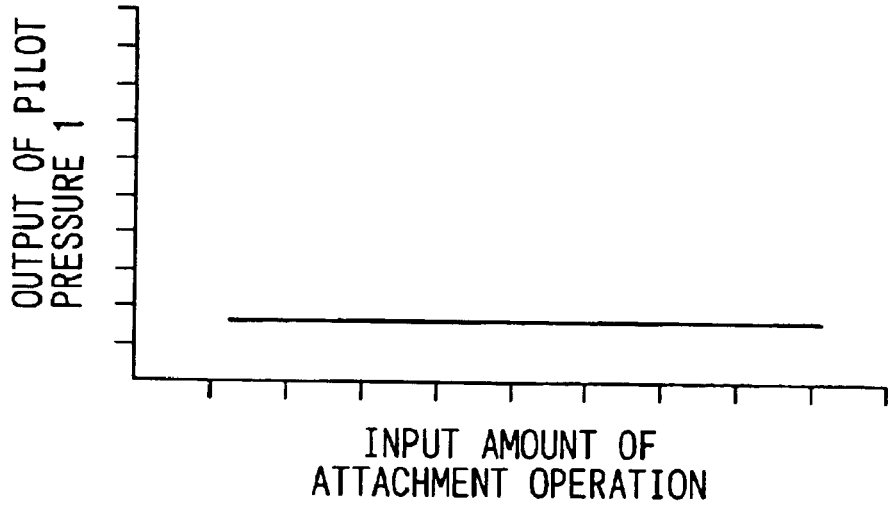
FIG. 27 is a characteristic diagram showing control characteristics to control pilot pressure output with respect to amounts of operation input to the two attachment control valves set in Table 3-5.
Figure 27:
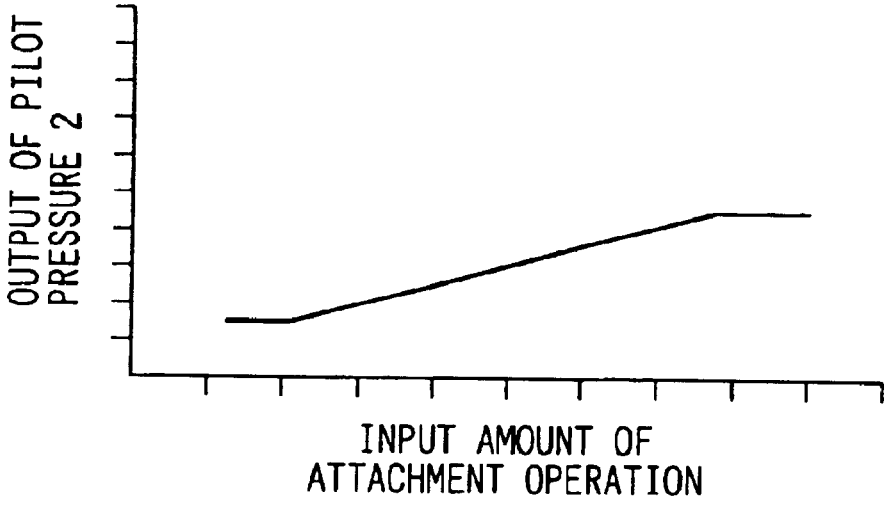
Figure 28:
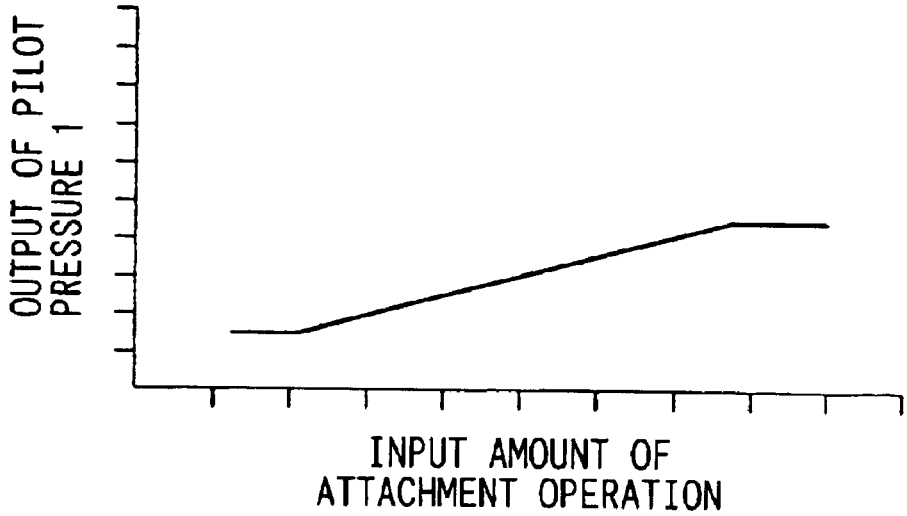
FIG. 28 is a characteristic diagram showing control characteristics to control pilot pressure output with respect to amounts of operation input to the two attachment control valves set in Table 3-6.
Figure 28:
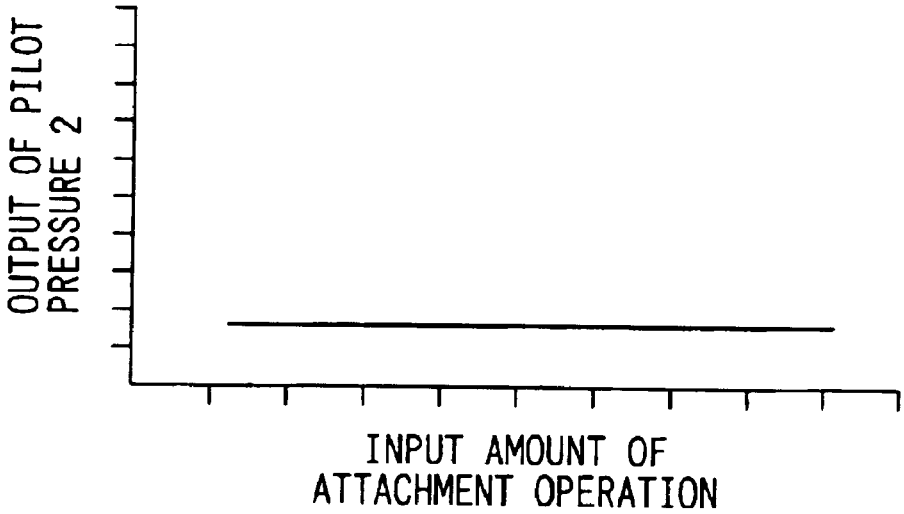
Figure 29:
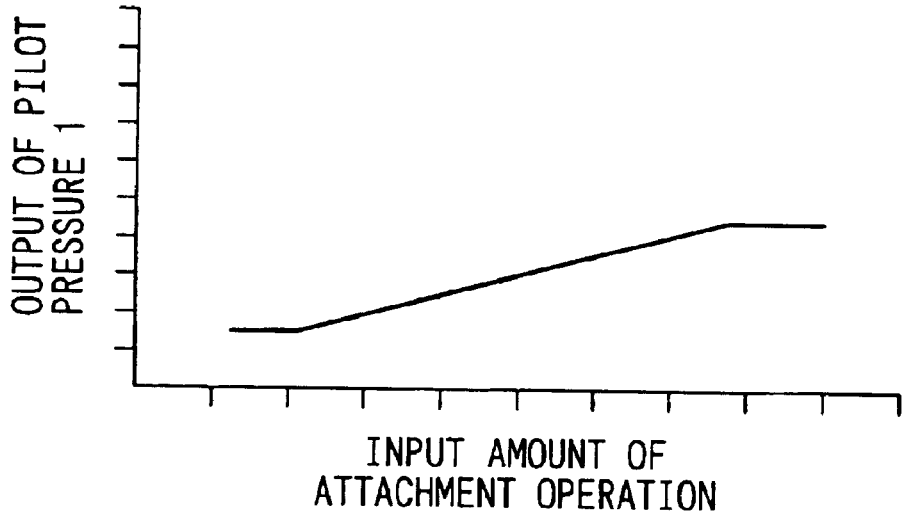
FIG. 29 is a characteristic diagram showing control characteristics to control pilot pressure output with respect to amounts of operation input to the two attachment control valves set in Table 3-7.
Figure 29:
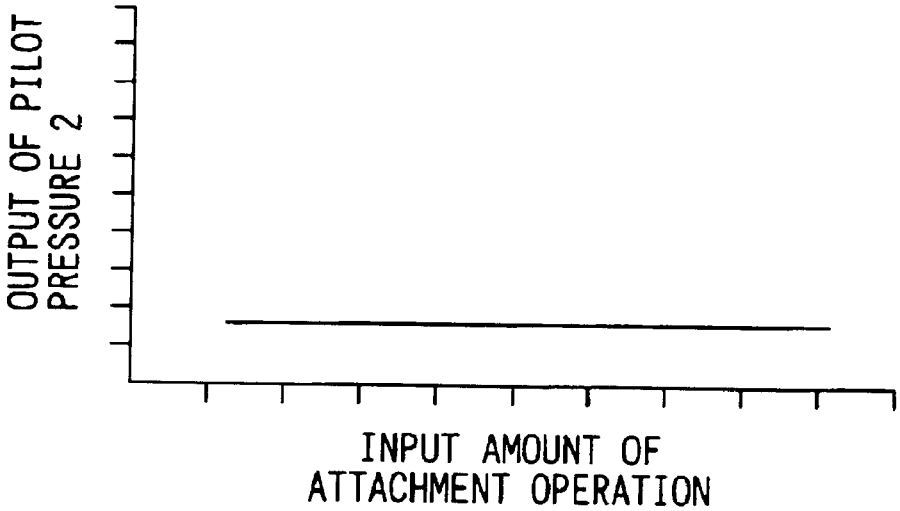
Figure 30:
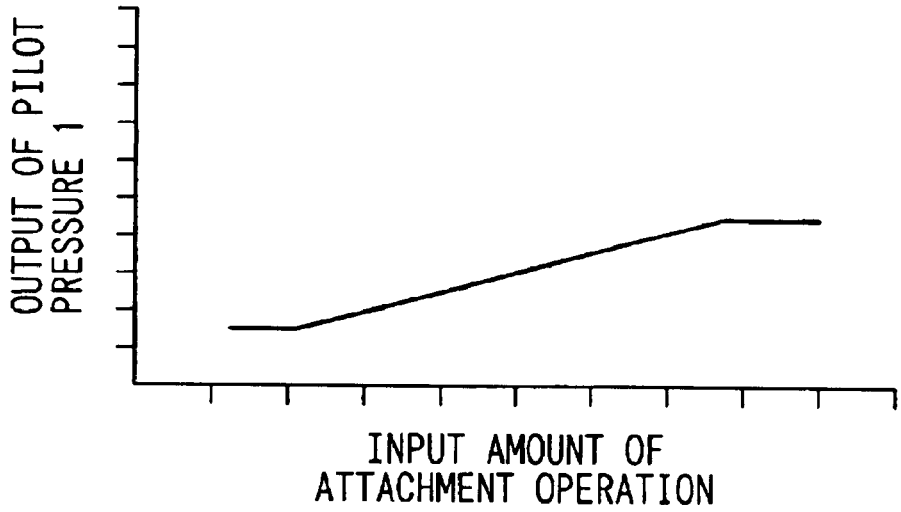
FIG. 30 is a characteristic diagram showing control characteristics to control pilot pressure output with respect to amounts of operation input to the two attachment control valves set in Table 3-8.
Figure 30:
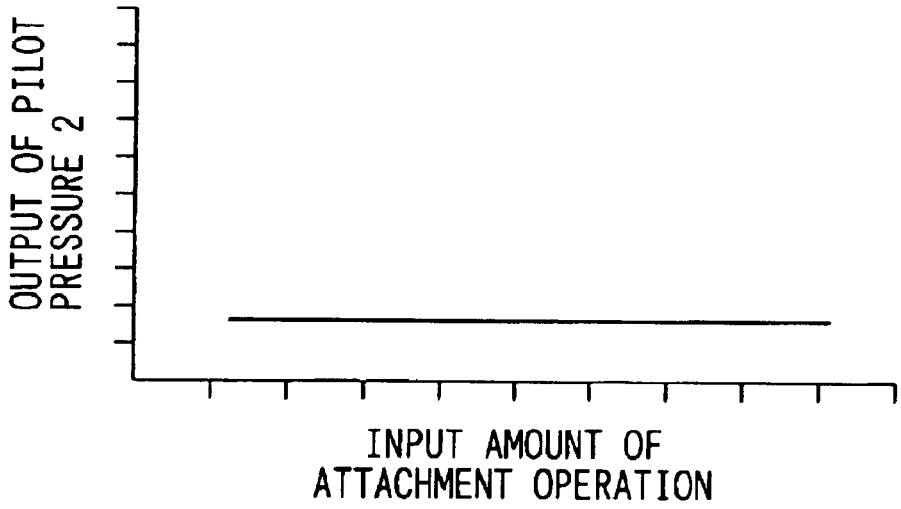

To be more specific, as shown in FIG. 25(*a*), FIG. 27(*b*), FIG. 28(*a*), FIG. 29(*a*), FIG. 30(*a*), and other relevant drawings, combined operation of the attachment actuator 60 and the other actuators 52,54,56,58 can be optimized by reducing the output signal ratio with respect to the amount of operation to be input into the attachment control valves 27,28 so as to increase by the reduced amount the pressure and the flow rate of the hydraulic oil applied to the other actuator 52,54,56,58, which is exposed to a heavy load.

Also connected to the controller 43 is a control characteristic overwriting device 46 adapted to overwrite control characteristics currently stored in the controller 43 with other control characteristics that correspond to some other attachment actuator 60. The control characteristic overwriting device 46 is a device for inputting the new data from a keyboard, a keypad, or an information medium that stores the new data into the memory of the controller 43.

When using some other attachment actuator 60 that was not originally to be used, the control characteristic overwriting device 46 permits the control of the hydraulic circuit with the optimal control characteristics by overwriting the control characteristics at any desired time.

As shown in FIG. 39, the attachment actuator 60 in the present embodiment is an actuator for operating the attachment 59 attached to the fore end of the working device of a hydraulic excavator, whereas the other actuators 52,54,56,58 are working actuators other than the attachment actuator 60. Therefore, the embodiment is capable of improving combined operatability of the attachment actuator 60, which requires the highest flow rate of the actuators of the working device of a hydraulic excavator, with the other actuator 52,54,56,58 of the working device. The embodiment also ensures the attachment actuator 60 to be operated at the maximum speed when it is operated in the single operation mode.

The controller 43 is capable of storing a plurality of control patterns ([Setting 1], [Setting 2], [Setting 3], and [Setting 1]) consisting of a plurality of control characteristics of the attachment control valves 27,28 that are grouped in accordance with a plurality of attachments 59, which can be interchangeably attached to the same working device. The controller 43 is provided with the aforementioned control pattern selecting device 45, which is capable of choosing, when the attachment is changed, a pattern appropriate for the actuator of the newly connected attachment from among these control patterns. The presence of the control pattern selecting device 45 is particularly effective in demolition or other work that must be performed while changing a plurality of attachments 59; rather than setting or adjusting control conditions each time the attachment is changed, a plurality of control characteristics can be set collectively by choosing the control patters appropriate for the attachments to be used from among a plurality of control patterns that have been formed beforehand by grouping a plurality of control conditions. Therefore, the control pattern selecting device 45 facilitates adjusting operation when changing the attachment.

Next are more concrete descriptions of the functions of the controller 43 and other elements. For the sake of simplicity, a simplified system that solely uses turning pilot pressure P1, boom pilot pressure P2, and bucket pilot pressure P3 as discrimination signals output from the discriminating means, with these pressures P1,P2,P3 serving as control conditions input into the controller 43. The following explanation describes how combined operatability can be improved by changing control characteristics of the left and right pilot pressures 1,2 for the attachments in accordance with a combination of the three respective ranges of pressures. Said control characteristics are shown in FIGS. 7 through 38.

FIGS. 2 through 6 are flow charts showing the process of selecting a control pattern and control characteristics for the attachment pilot pressures. In the flow charts, numerals enclosed with circles represent step numbers that show procedures.

(Step 1)

Figure 2:
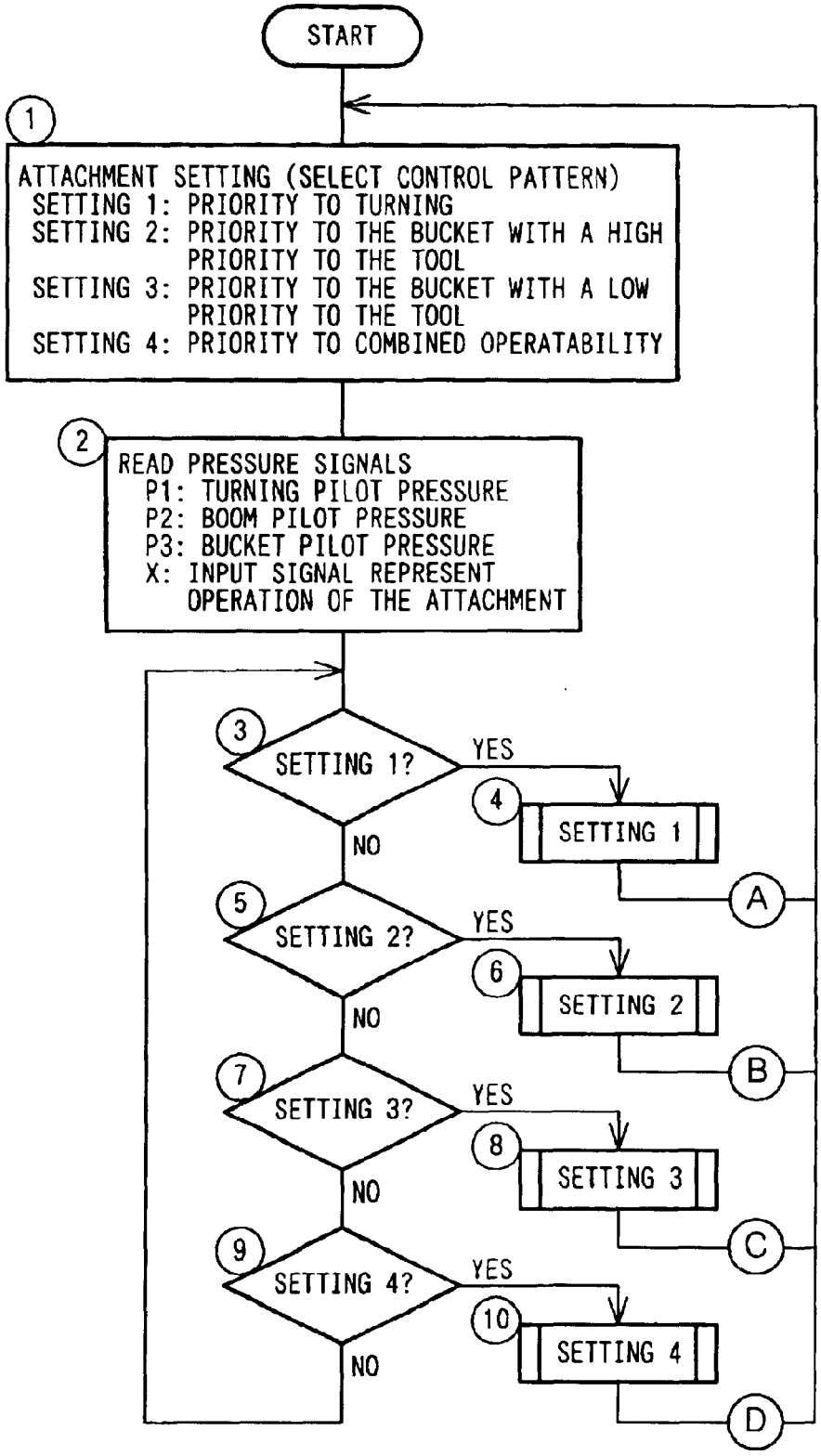
FIG. 2 is a flow chart to explain the process of setting operating conditions of an attachment by said control system.

FIG. 2 shows an example of selection of control patterns for the attachment pilot pressures, wherein selection can be made from among four control patterns: [Setting 1] for giving priority to turning, [Setting 2] for giving priority to the bucket with a high priority allocated to the tool, [Setting 3] for giving priority to the bucket with a low priority allocated to the tool, and [Setting 4] for giving priority to combined operatability.

Giving priority to turning is a setting suitable for an open/close attachment 59, such as an open/close breaker, which is often used while the super structure is revolved. Giving priority to the bucket is a setting suitable for an attachment that may be subject to adjustment of the angle of its impact by the attachment actuator 58 in the course of operation. A typical example of such attachments is a breaker (a rock crushing tool). Allocating a high or low priority to the tool should be based on the weight of the attachment 59; "a low priority to the tool" should be selected when the attachment 59 is heavy, because the heavier the attachment 59, the greater the load applied to the boom actuators 54. Giving priority to combined operatability is a setting for preventing sudden change in the operation speed of the attachment actuator 60, in other words the operation speed of the attachment, when operating the attachment actuator 60 together with an actuator that uses hydraulic oil from both pumps, such as the boom actuators 54 or the stick actuator 56.

(Step 2)

Turning pilot pressure P1, boom pilot pressure P2, bucket pilot pressure P3, and the amount X of attachment operation to be input, i.e. an input signal represent operation of the attachment, are read into the controller 43.

(Steps 3 through 10)

In accordance with the nature of work, one pattern is chosen from a plurality of settings: [Setting 1] for giving priority to turning, [Setting 2] for giving priority to the bucket with a high priority allocated to the tool, [Setting 3] for giving priority to the bucket with a low priority allocated to the tool, and [Setting 4] for giving priority to combined operatability by means of the control pattern selecting device 45.

For example, when choosing [Setting 3], the flow chart indicates the selection of "NO" in Step 3 and Step 5, and then "YES" in Step 7. In an actual operation, however, selection can be made by operating the control pattern selecting device 45 to merely choose one from among [Setting 1], [Setting 2], [Setting 3], and [Setting 4].

In cases where the attachment 59 is an open/close breaker, which is often used while the upper structure 53 is revolving, [Setting 1] for giving priority to turning should be chosen. In cases where the attachment 59 is a breaker, which may be subject to adjustment of the angle of its impact by the bucket actuator 58 in the course of operation, [Setting 2] or [Setting 3] for giving priority to the bucket should be chosen. In cases where the attachment 59 is heavy, combined operatability with any other actuator, such as the boom actuators 54 adapted to raise or lower the attachment 59, can be optimized by selecting [Setting 3], which is a setting for reducing the priority to the attachment 59. When operating the attachment actuator 60 simultaneously with an actuator that uses hydraulic oil from both pumps, such as the boom actuators 54 or the stick actuator 56, the operatability of the attachment 59 can be improved by selecting [Setting 4] for giving priority to combined operatability so as to prevent sudden change in the operation speed of the attachment.

[Setting 1], which is a setting for giving priority to turning, and [Setting 2] and [Setting 3], both of which give priority to the bucket, call for returning the spool of either one of the attachment control valves 27,28 completely to the neutral position during the combined operation mode. This feature gives the attachment actuator 60 good operatability for combined operation with an actuator, such as the turning actuator 52 or the bucket actuator 58, that uses hydraulic oil from a single pump. However, when operating the attachment actuator 60 together with an actuator, such as the boom actuators 54 or the stick actuator 56, that uses hydraulic oil from both pumps, a sudden change may occur in the operation speed of the attachment actuator 60 and impair its operatability. This can be prevented by choosing [Setting 4] for giving priority to combined operatability. Choosing [Setting 4] slows down the overall working speed. On the other hand, as it ensures constant supply of the hydraulic oil from the two pumps to the attachment actuator 60, it facilitates operation of the attachment 59 by eliminating the possibility of a sudden change in the operation speed of the attachment during combined operation with another actuator that uses hydraulic oil from both pumps.

(Step 4)

Figure 3:
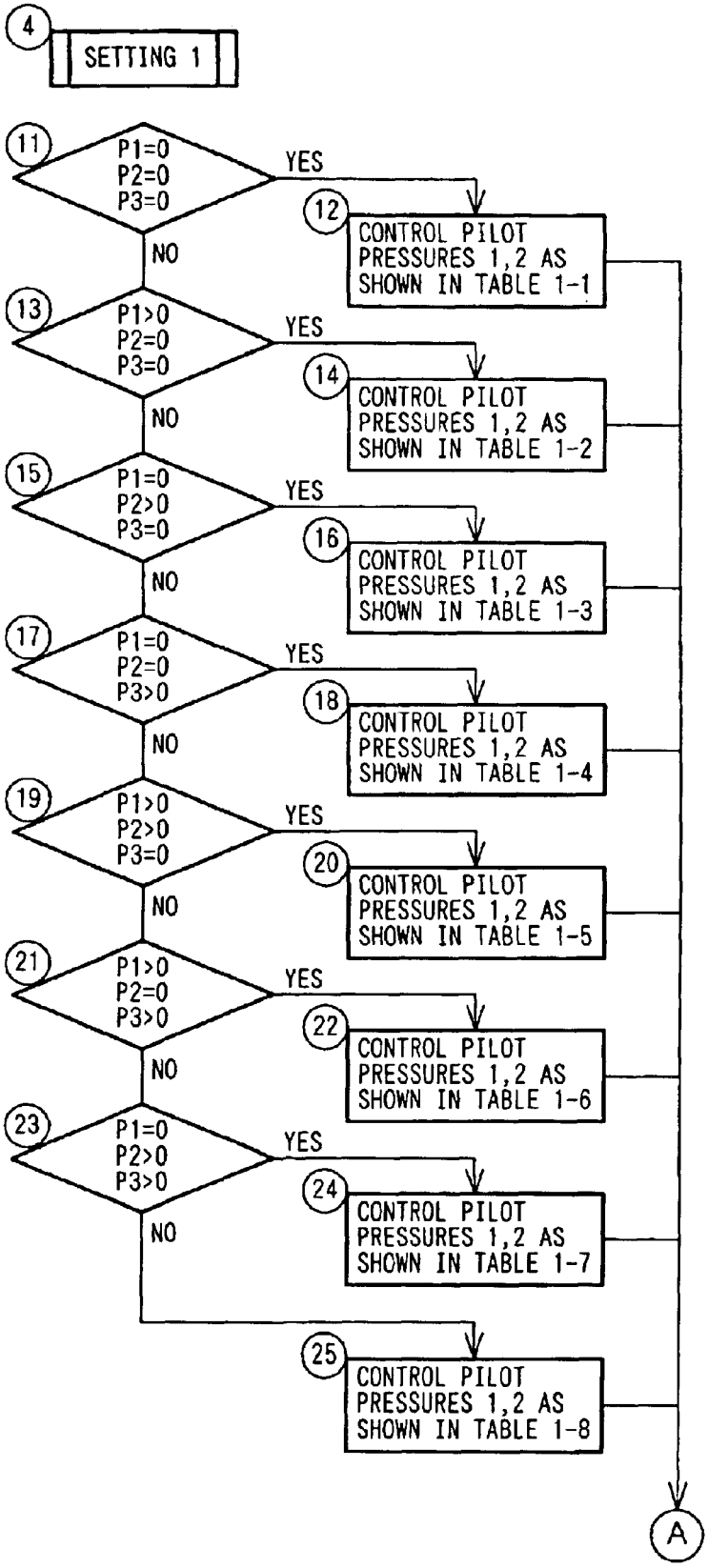
FIG. 3 is a flow chart showing Setting 1 of said process of attachment setting.

First, referring to the flow chart shown in FIG. 3, a case where [Setting 1] for giving priority to turning has been chosen in attachment setting in the flow chart shown in FIG. 2 ("Yes" in Step 3) is explained hereunder.

(Step 11,12)

Figure 7:
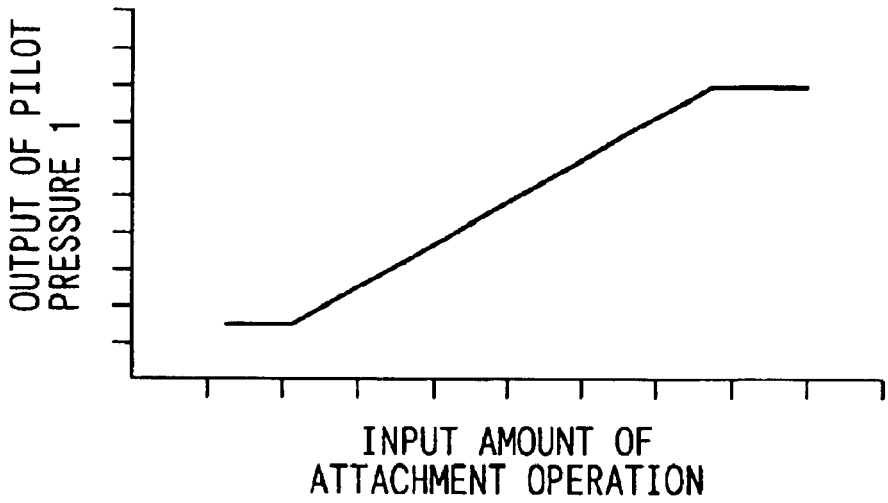
FIG. 7 is a characteristic diagram showing control characteristics to control pilot pressure output with respect to amounts of operation input to two attachment control valves set in Table 1-1.
Figure 7:
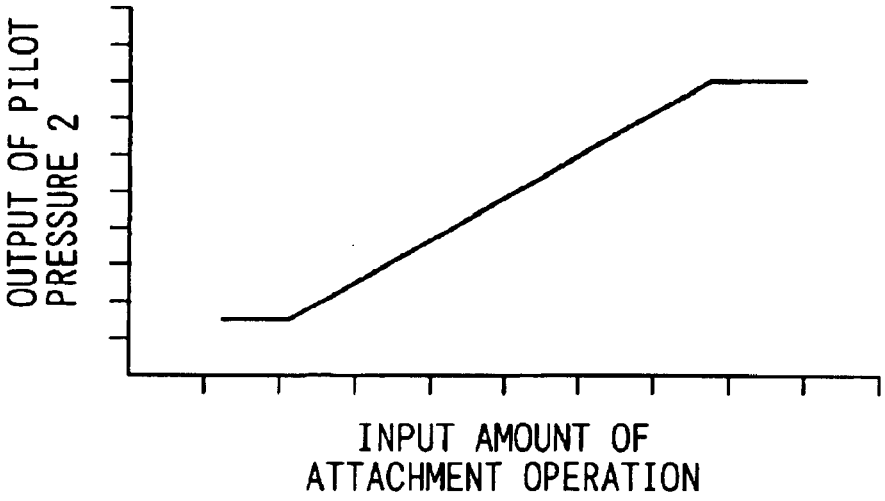

When the attachment actuator 60 is operated to work in the single operation mode, in other words when the attachment actuator 60 is operated when P1=P2=P3=0 in the control pattern for giving priority to turning, the right and left pilot pressures for the attachment are controlled, as shown in FIGS. 7(*a*) and (*b*), in proportion to the input amount of attachment operation according to the control characteristics set in Table 1-1.

(Step 13,14)

Figure 8:
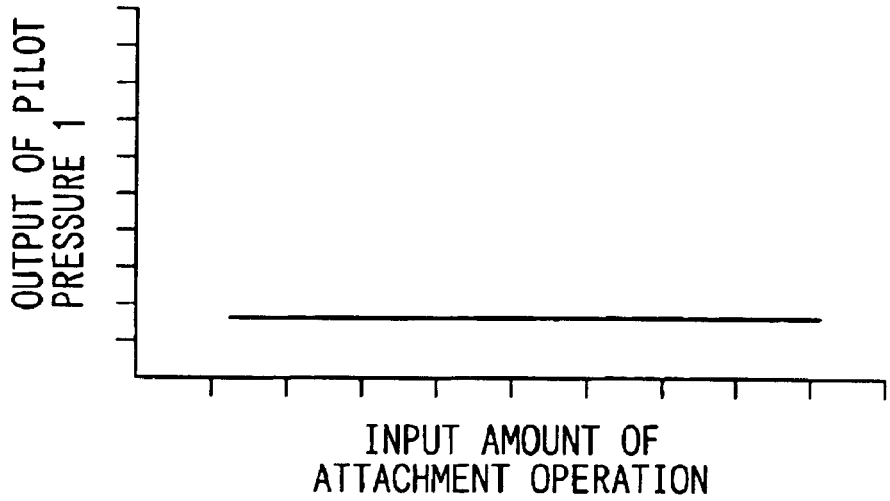
FIG. 8 is a characteristic diagram showing control characteristics to control pilot pressure output with respect to amounts of operation input to the two attachment control valves set in Table 1-2.
Figure 8:
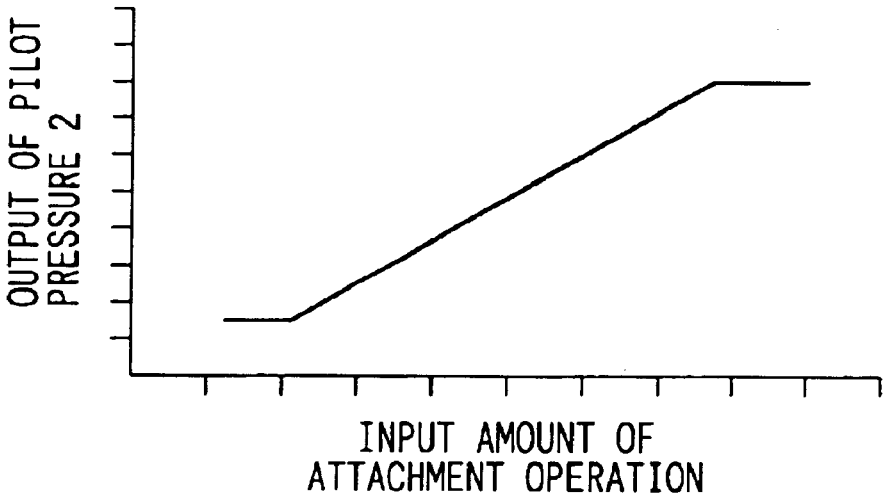

When the attachment actuator 60 is operated to work simultaneously with the turning actuator 52, in other words when the attachment actuator 60 is operated when P1>0 and P2=P3=0 in the control pattern for giving priority to turning, the right and left pilot pressures for the attachment are controlled as shown in FIGS. 8(*a*) and (*b*). To be more specific, the right pilot pressure 2 is controlled in proportion to the input amount of attachment operation according to the control characteristics set in Table 1-2, while the left pilot pressure 1 is maintained at zero so that the hydraulic pressure and flow rate from the left pump 12 are supplied only to the turning actuator 52, without being used for the attachment actuator 60.

(Step 15,16)

Figure 9:
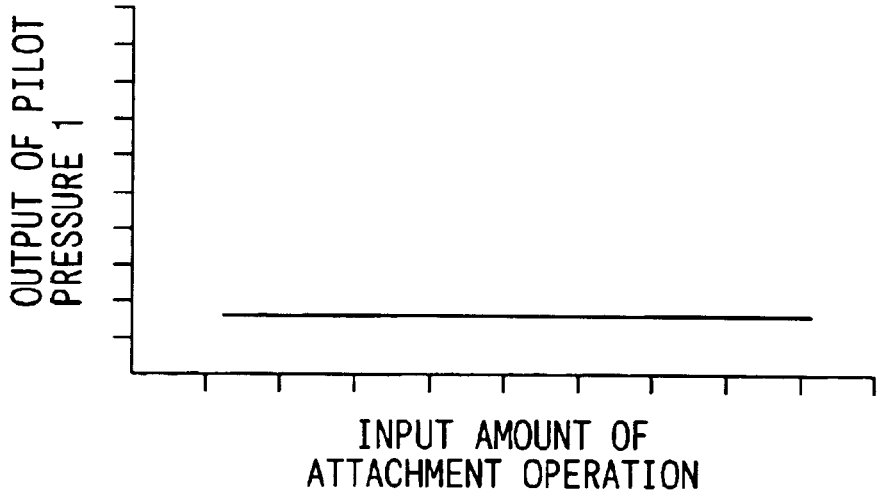
FIG. 9 is a characteristic diagram showing control characteristics to control pilot pressure output with respect to amounts of operation input to the two attachment control valves set in Table 1-3.
Figure 9:
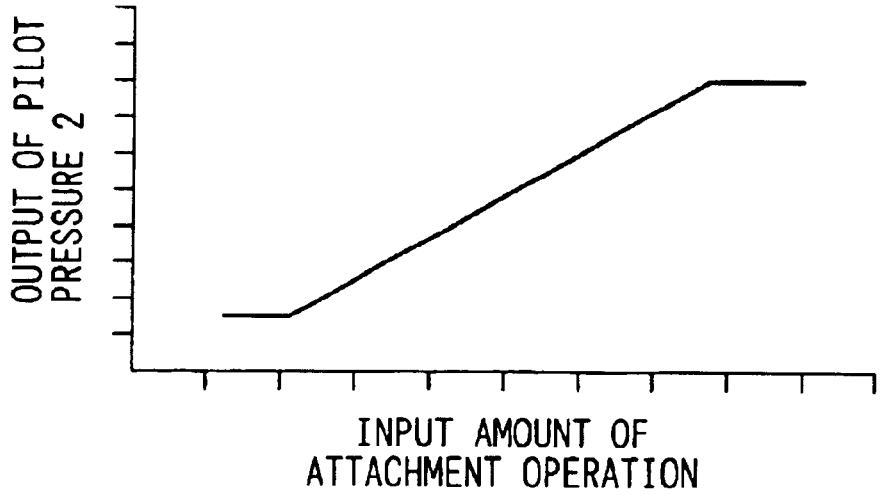

When the attachment actuator 60 is operated to work simultaneously with the boom actuators 54, in other words when the attachment actuator 60 is operated when P1=0, P2>0, and P3=0 in the control pattern for giving priority to turning, the right and left pilot pressures for the attachment are controlled as shown in FIGS. 9(*a*) and (*b*). To be more specific, the right pilot pressure 2 is controlled in proportion to the input amount of attachment operation according to the control characteristics set in Table 1-3, while the left pilot pressure 1 is maintained at zero so that the hydraulic pressure and flow rate from the left pump 12 are supplied only to the boom actuators 54, without being used for the attachment actuator 60.

(Step 17,18)

Figure 10:
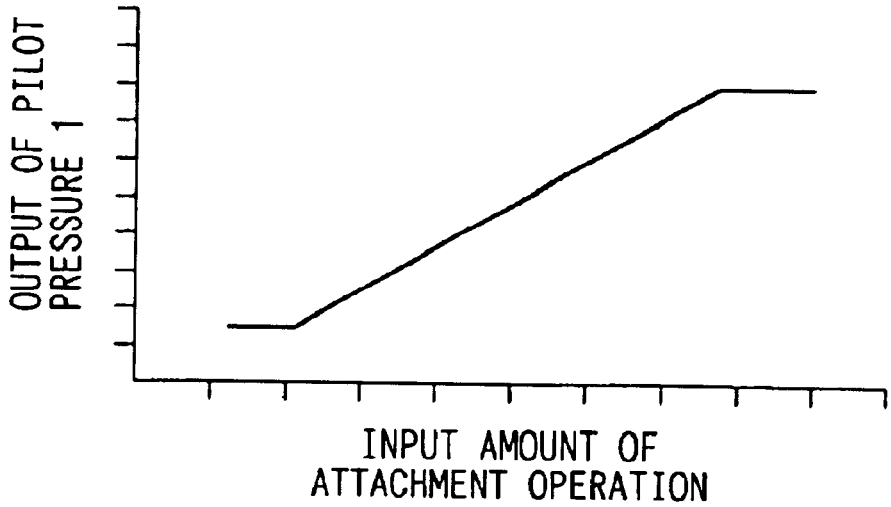
FIG. 10 is acharacteristic diagram showing control characteristics to control pilot pressure output with respect to amounts of operation input to the two attachment control valves set in Table 1-4.
Figure 10:
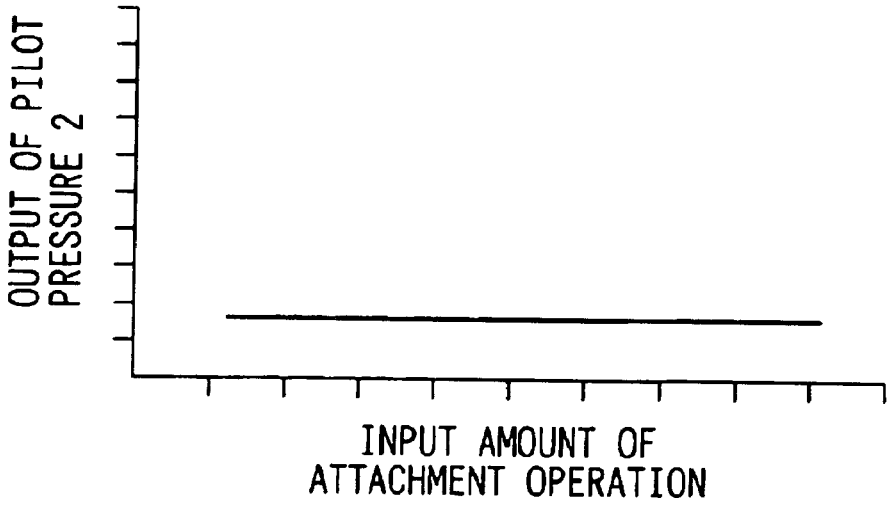

When the attachment actuator 60 is operated to work simultaneously with the bucket actuator 58, in other words when the attachment actuator 60 is operated when P1=P2=0 and P3>0 in the control pattern for giving priority to turning, the right and left pilot pressures for the attachment are controlled as shown in FIGS. 10(*a*) and (*b*). To be more specific, the left pilot pressure 1 is controlled in proportion to the input amount of attachment operation according to the control characteristics set in Table 1-4, while the right pilot pressure 2 is maintained at zero so that the hydraulic pressure and flow from the right pump 13 are supplied only to the bucket actuator 58, without being used for the attachment actuator 60.

(Step 19,20)

Figure 11:
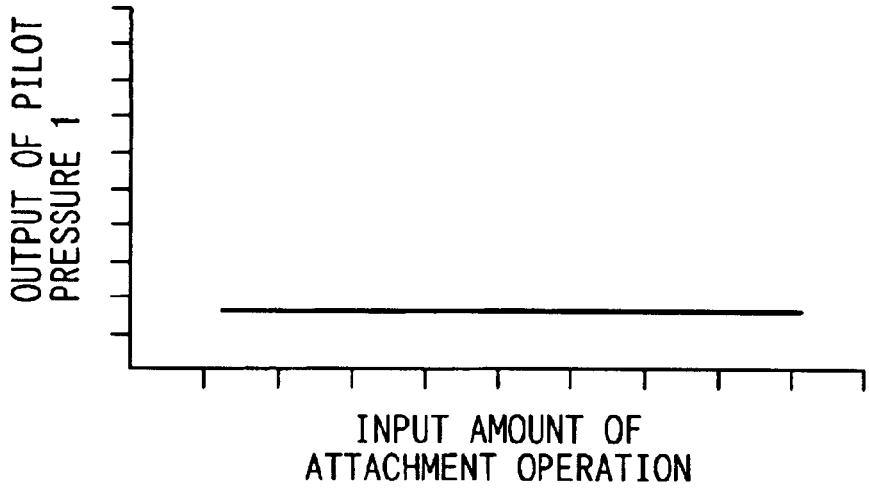
FIG. 11 is a characteristic diagram showing control characteristics to control pilot pressure output with respect to amounts of operation input to the two attachment control valves set in Table 1-5.
Figure 11:
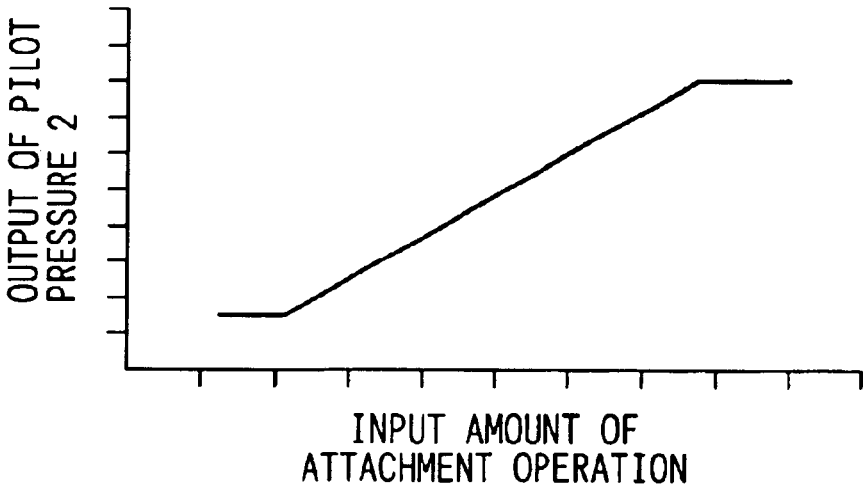

When the turning actuator 52, the boom actuators 54, and the attachment actuator 60 are operated to work simultaneously, in other words when the attachment actuator 60 is operated when P1>0, P2>0, and P3=0 in the control pattern for giving priority to turning, the right and left pilot pressures for the attachment are controlled as shown in FIGS. 11(*a*) and (*b*). To be more specific, the right pilot pressure 2 is controlled in proportion to the input amount of attachment operation according to the control characteristics set in Table 1-5, while the left pilot pressure 1 is maintained at zero so that the hydraulic oil from the left pump 12 is not used for the attachment actuator 60 and supplied to either the turning actuator 52 or the boom actuators 54, whichever may be of lower pressure.

(Step 21,22)

Figure 12:
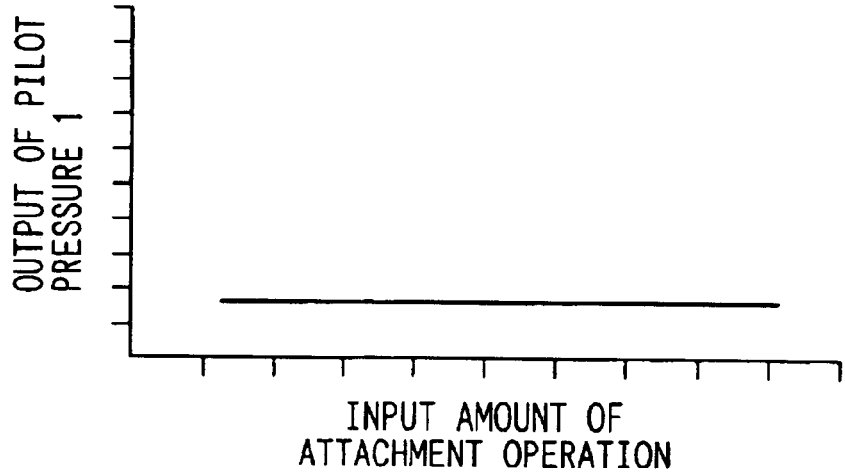
FIG. 12 is a characteristic diagram showing control characteristics to control pilot pressure output with respect to amounts of operation input to the two attachment control valves set in Table 1-6.
Figure 12:
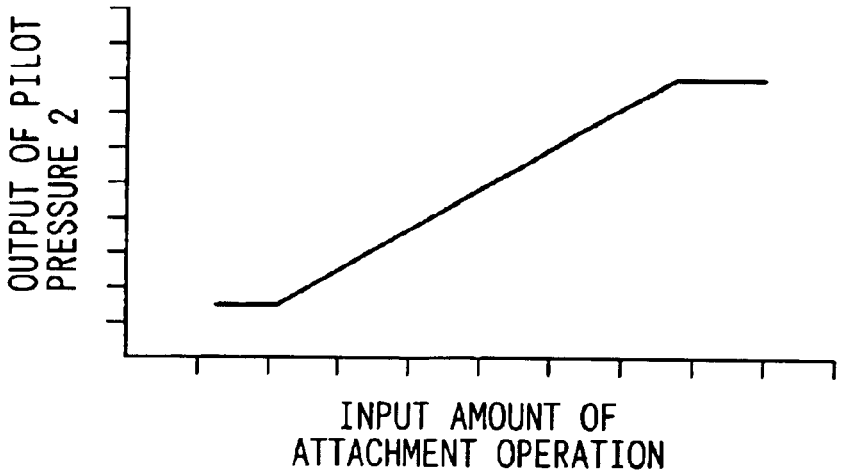

When the turning actuator 52, the bucket actuator 58, and the attachment actuator 60 are operated to work simultaneously, in other words when the attachment actuator 60 is operated when P1>0, P2=0, and P3>0 in the control pattern for giving priority to turning, the right and left pilot pressures for the attachment are controlled as shown in FIGS. 12(*a*) and (*b*). To be more specific, the right pilot pressure 2 is controlled in proportion to the input amount of attachment operation according to the control characteristics set in Table 1-6, while the left pilot pressure 1 is maintained at zero so that the hydraulic pressure and flow from the left pump 12 are supplied only to the turning actuator 52, without being used for the attachment actuator 60.

(Step 23,24)

Figure 13:
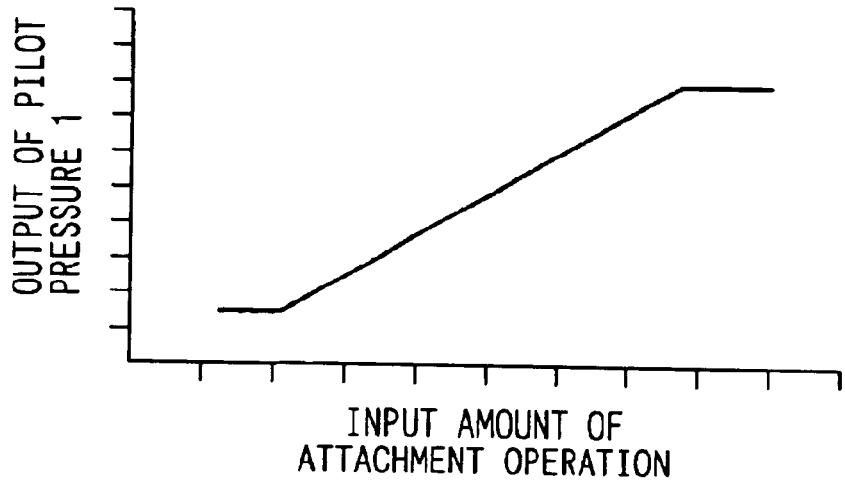
FIG. 13 is a characteristic diagram showing control characteristics to control pilot pressure output with respect to amounts of operation input to the two attachment control valves set in Table 1-7.
Figure 13:
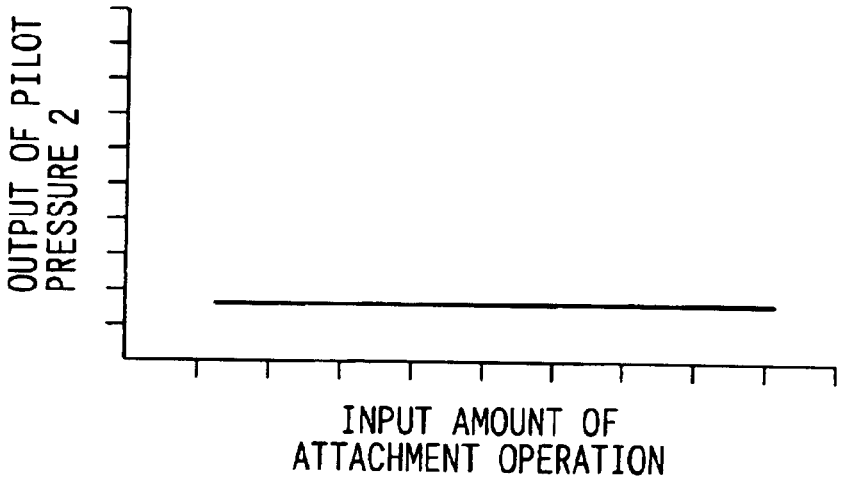

When the boom actuators 54, the bucket actuator 58, and the attachment actuator 60 are operated to work simultaneously, in other words when the attachment actuator 60 is operated when P1=0, P2>0, and P3>0 in the control pattern for giving priority to turning, the right and left pilot pressures for the attachment are controlled as shown in FIGS. 13(*a*) and (*b*). To be more specific, the left pilot pressure 1 is controlled in proportion to the input amount of attachment operation according to the control characteristics set in Table 1-7, while the right pilot pressure 2 is maintained at zero so that the hydraulic oil from the right pump 13 is not used for the attachment actuator 60 and supplied to either the bucket actuator 58 or the boom actuators 54, whichever may be of lower pressure.

(Step 25)

Figure 14:
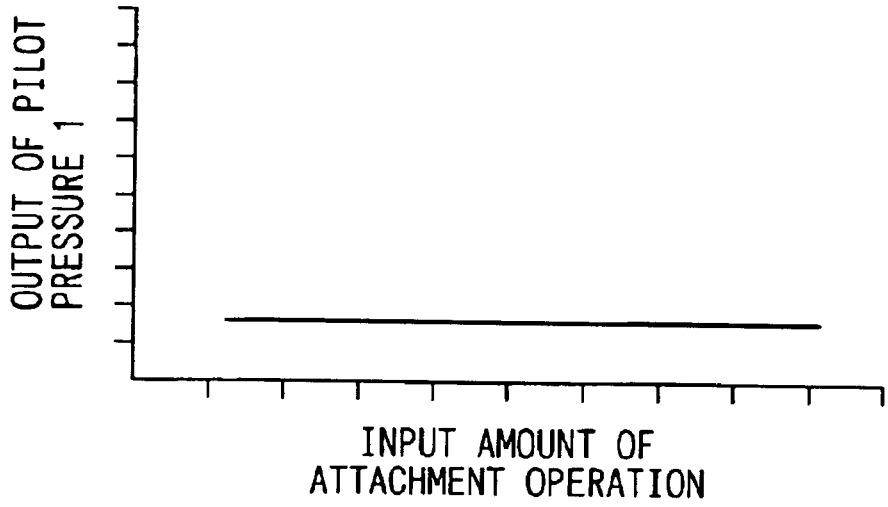
FIG. 14 is a characteristic diagram showing control characteristics to control pilot pressure output with respect to amounts of operation input to the two attachment control valves set in Table 1-8.
Figure 14:
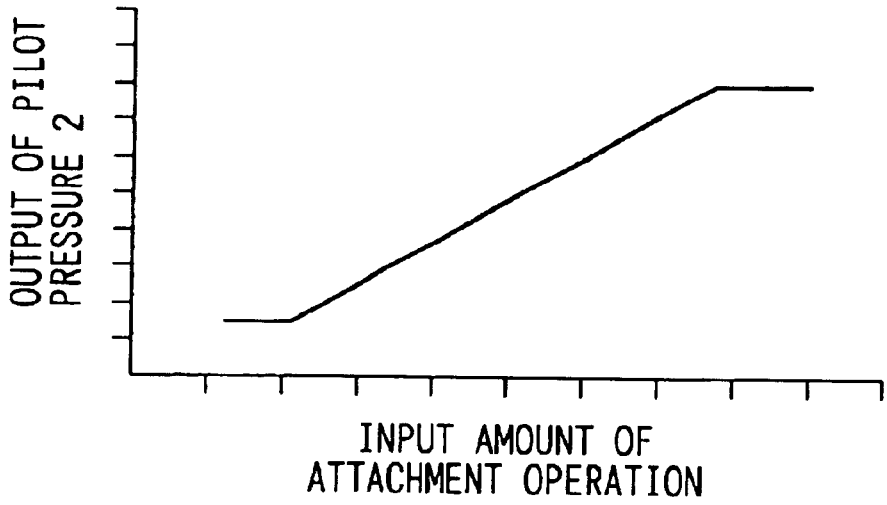

When the turning actuator 52, the boom actuators 54, the bucket actuator 58, and the attachment actuator 60 are operated to work simultaneously, in other words when the attachment actuator 60 is operated when P1>0, P2>0, and P3>0 in the control pattern for giving priority to turning, the right and left pilot pressures for the attachment are controlled as shown in FIGS. 14(*a*) and (*b*). To be more specific, the right pilot pressure 2 is controlled in proportion to the input amount of attachment operation according to the control characteristics set in Table 1-8, while the left pilot pressure 1 is maintained at zero so that the hydraulic oil from the left pump 12 is not used for the attachment actuator 60 and supplied to either the turning actuator 52 or the boom actuators 54, whichever may be of lower pressure.

(Step 6)

Figure 4:
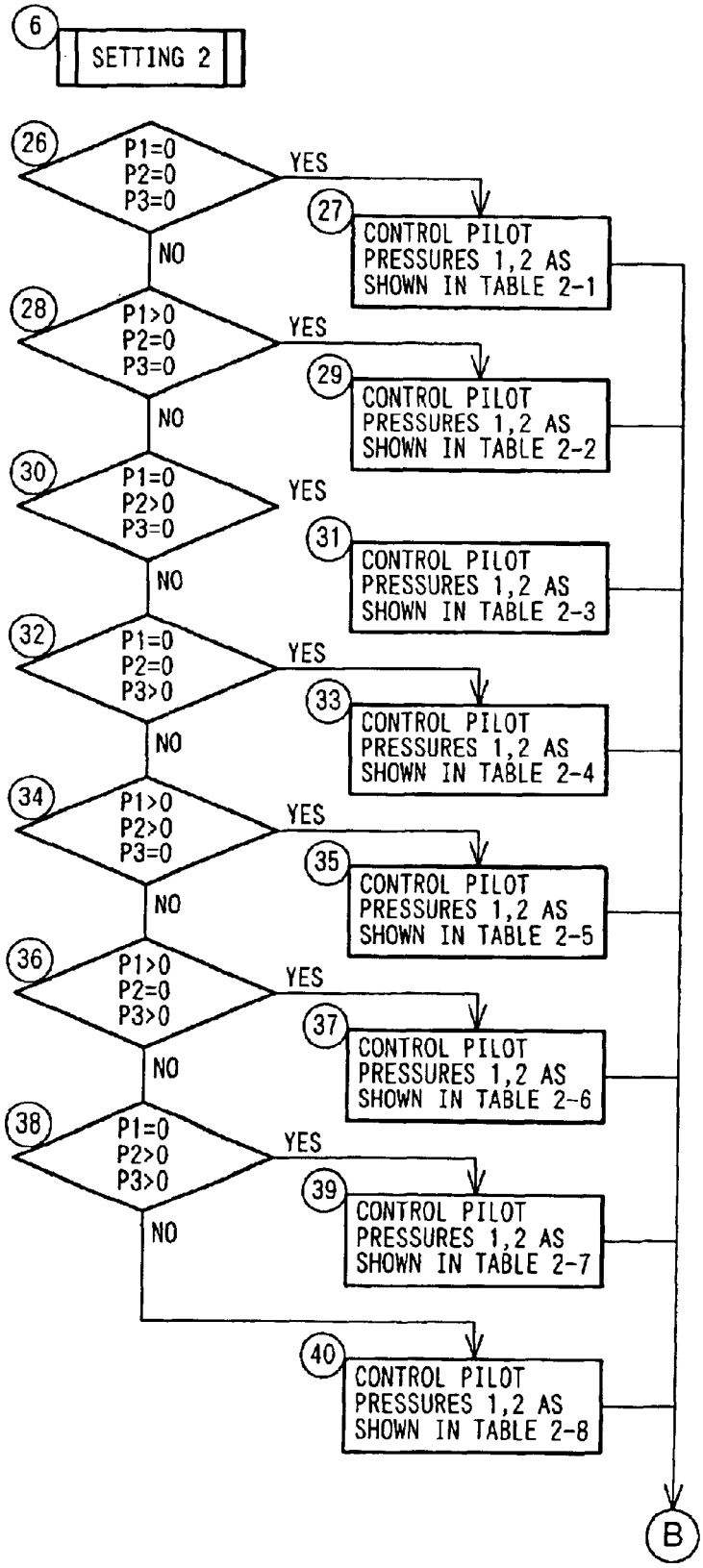
FIG. 4 is a flow chart showing Setting 2 of said process of attachment setting.

Second, referring to the flow chart shown in FIG. 4, a case where [Setting 2] for giving priority to the bucket with a high priority allocated to the attachment has been chosen in attachment setting in the flow chart shown in FIG. 2 ("Yes" in Step 5) is explained hereunder.

(Step 26,27)

Figure 15:
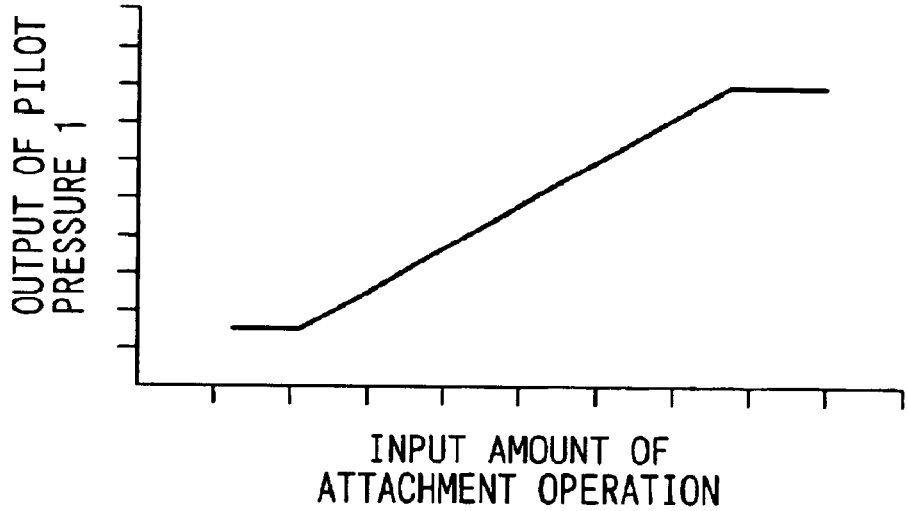
FIG. 15 is a characteristic diagram showing control characteristics to control pilot pressure output with respect to amounts of operation input to the two attachment control valves set in Table 2-1.
Figure 15:
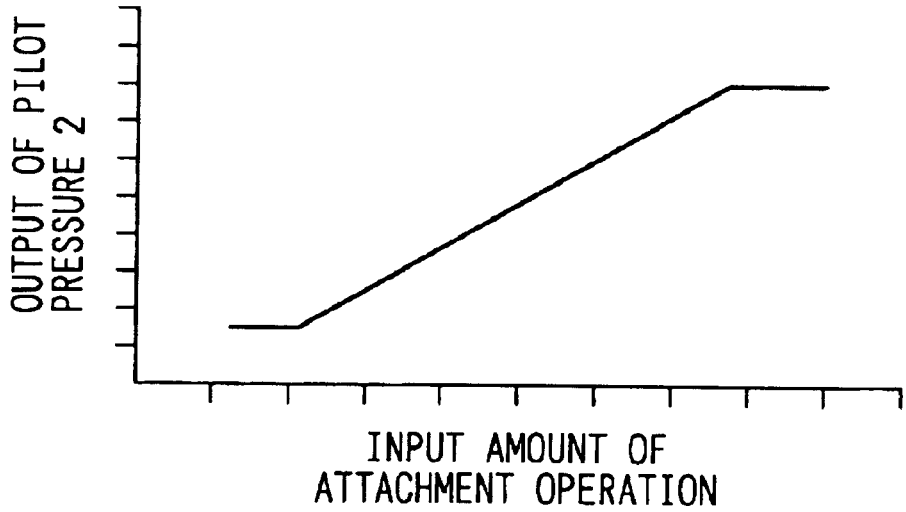

When the attachment actuator 60 is operated to work in the single operation mode, in other words when the attachment actuator 60 is operated when P1=P2=P3=0 in the control pattern for giving priority to the bucket with a high priority allocated to the attachment, the right and left pilot pressures for the attachment are controlled, as shown in FIGS. 15(*a*) and (*b*), in proportion to the input amount of attachment operation according to the control characteristics set in Table 2-1.

(Step 28,29)

Figure 16:
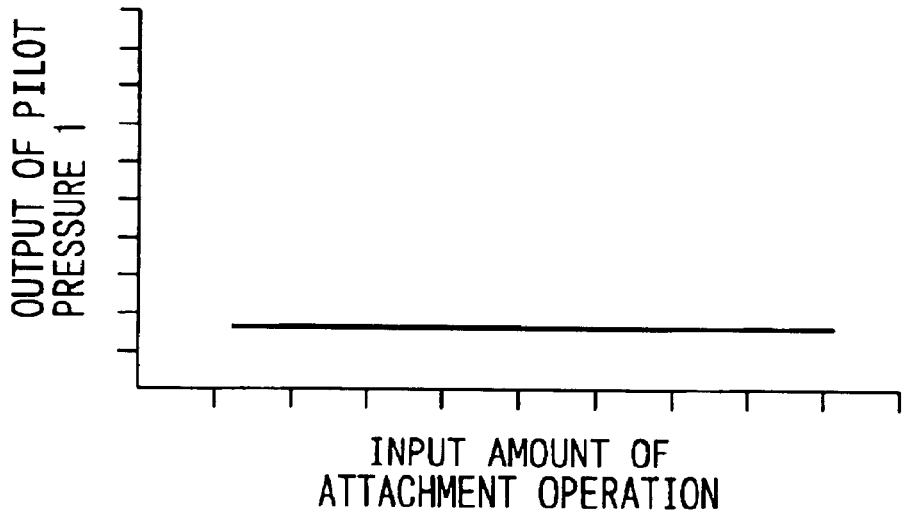
FIG. 16 is a characteristic diagram showing control characteristics to control pilot pressure output with respect to amounts of operation input to the two attachment control valves set in Table 2-2.
Figure 16:
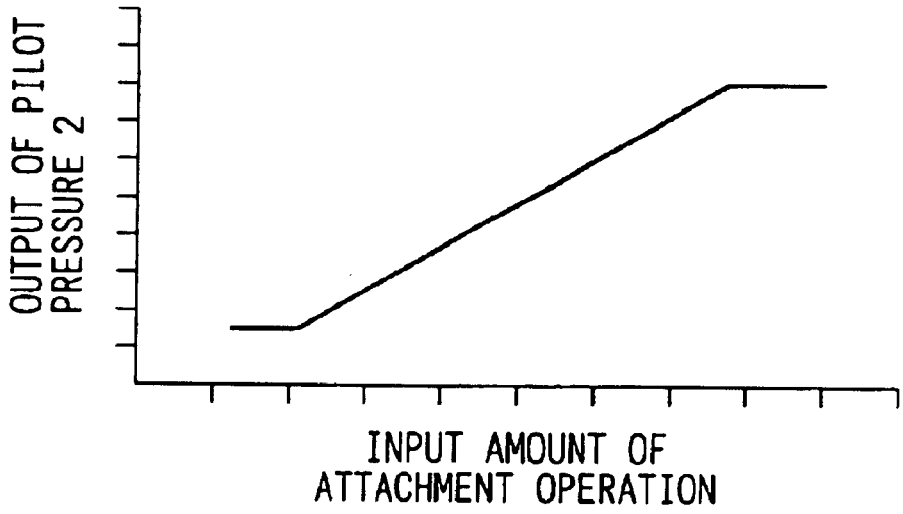

When the attachment actuator 60 is operated to work simultaneously with the turning actuator 52, in other words when the attachment actuator 60 is operated when P1>0 and P2=P3=0 in the control pattern for giving priority to the bucket with a high priority allocated to the attachment, the right and left pilot pressures for the attachment are controlled as shown in FIGS. 16(*a*) and (*b*). To be more specific, the right pilot pressure 2 is controlled in proportion to the input amount of attachment operation according to the control characteristics set in Table 2-2, while the left pilot pressure 1 is maintained at zero so that the hydraulic pressure and flow from the left pump 12 are supplied only to the turning actuator 52, without being used for the attachment actuator 60.

(Step 30,31)

Figure 17:
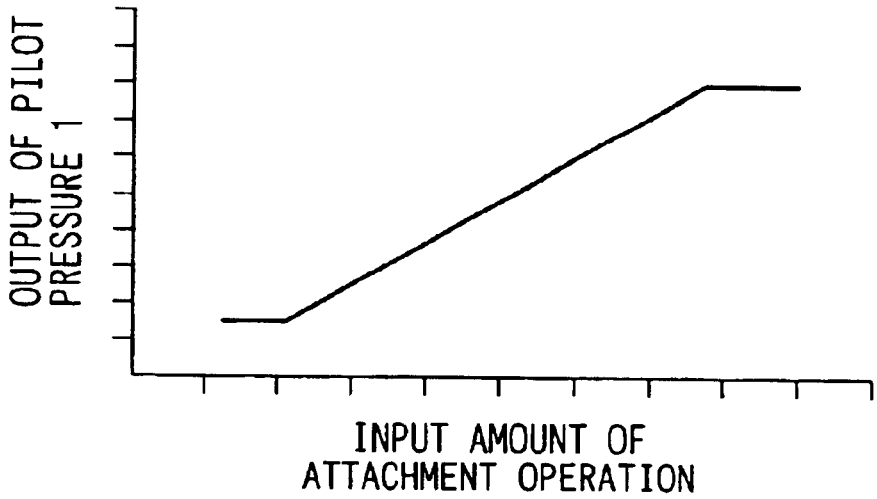
FIG. 17 is a characteristic diagram showing control characteristics to control pilot pressure output with respect to amounts of operation input to the two attachment control valves set in Table 2-3.
Figure 17:
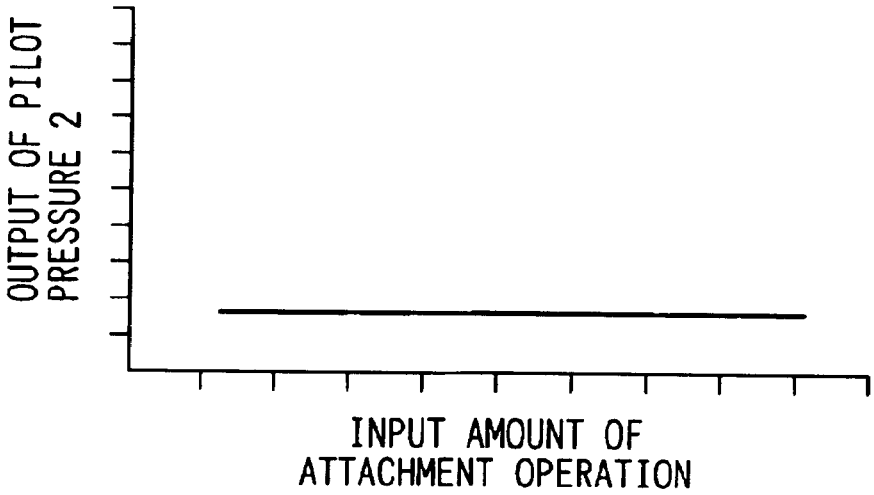

When the attachment actuator 60 is operated to work simultaneously with the boom actuators 54, in other words when the attachment actuator 60 is operated when P1=0, P2>0, and P3=0 in the control pattern for giving priority to the bucket with a high priority allocated to the attachment, the right and left pilot pressures for the attachment are controlled as shown in FIGS. 17(*a*) and (*b*). To be more specific, the left pilot pressure 1 is controlled in proportion to the input amount of attachment operation according to the control characteristics set in Table 2-3, while the right pilot pressure 2 is maintained at zero so that the hydraulic pressure and flow from the right pump 13 are supplied only to the boom actuators 54, without being used for the attachment actuator 60.

(Step 32,33)

Figure 18:
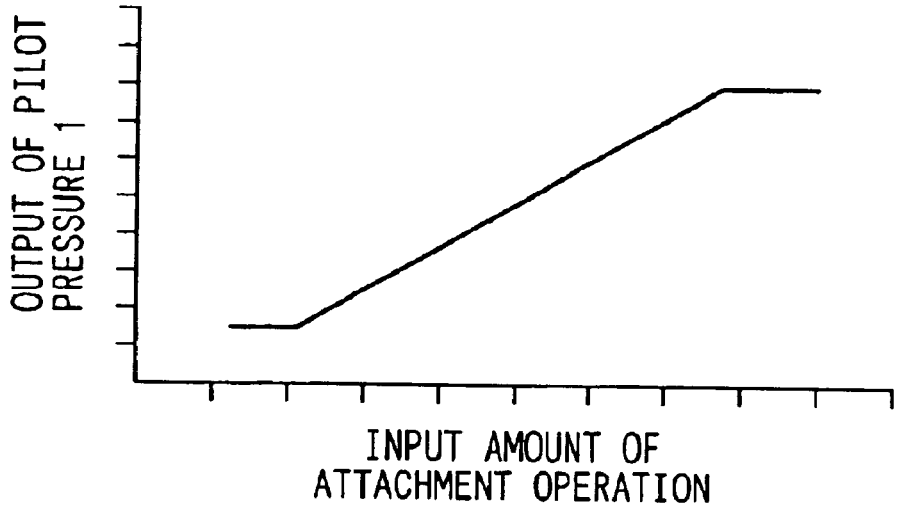
FIG. 18 is a characteristic diagram showing control characteristics to control pilot pressure output with respect to amounts of operation input to the two attachment control valves set in Table 2-4.
Figure 18:
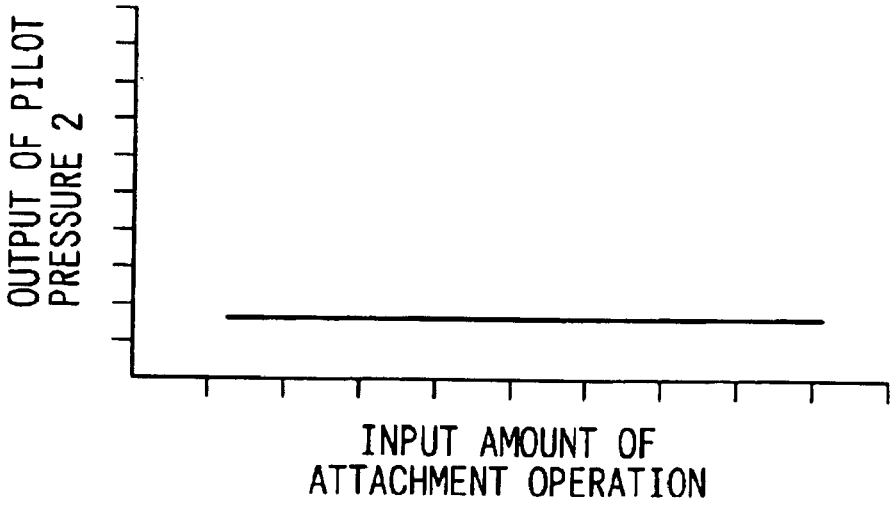

When the attachment actuator 60 is operated to work simultaneously with the bucket actuator 58, in other words when the attachment actuator 60 is operated when P1=P2=0 and P3>0 in the control pattern for giving priority to the bucket with a high priority allocated to the attachment, the right and left pilot pressures for the attachment are controlled as shown in FIGS. 18(*a*) and (*b*). To be more specific, the left pilot pressure 1 is controlled in proportion to the input amount of attachment operation according to the control characteristics set in Table 2-4, while the right pilot pressure 2 is maintained at zero so that the hydraulic pressure and flow from the right pump 13 are supplied only to the bucket actuator 58, without being used for the attachment actuator 60.

(Step 34,35)

Figure 19:
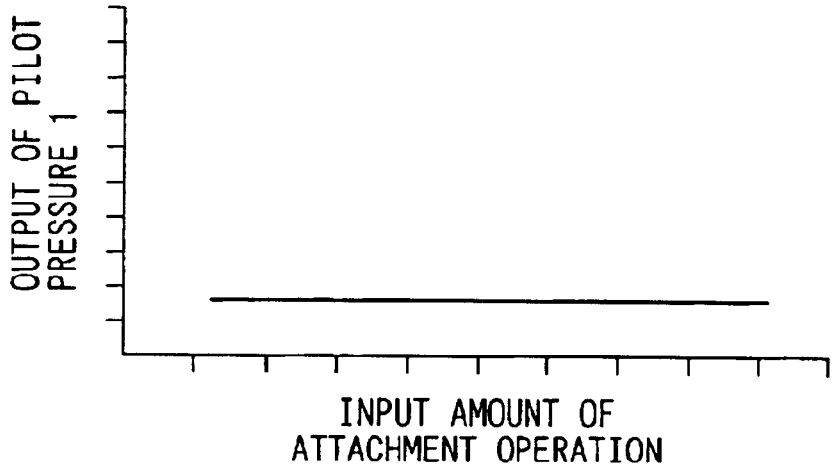
FIG. 19 is a characteristic diagram showing control characteristics to control pilot pressure output with respect to amounts of operation input to the two attachment control valves set in Table 2-5.
Figure 19:
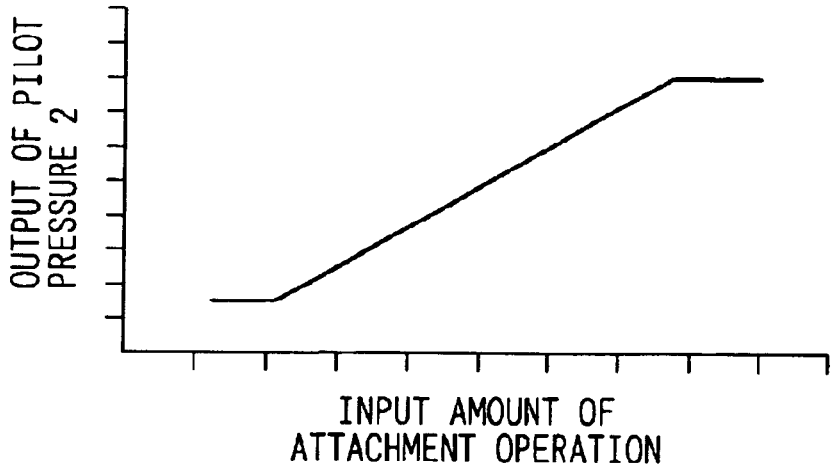

When the turning actuator 52, the boom actuators 54, and the attachment actuator 60 are operated to work simultaneously, in other words when the attachment actuator 60 is operated when P1>0, P2>0, and P3=0 in the control pattern for giving priority to the bucket with a high priority allocated to the attachment, the right and left pilot pressures for the attachment are controlled as shown in FIGS. 19(*a*) and (*b*). To be more specific, the right pilot pressure 2 is controlled in proportion to the input amount of attachment operation according to the control characteristics set in Table 2-5, while the left pilot pressure 1 is maintained at zero so that the hydraulic oil from the left pump 12 is not used for the attachment actuator 60 and supplied to either the turning actuator 52 or the boom actuators 54, whichever may be of lower pressure.

(Step 36,37)

Figure 20:
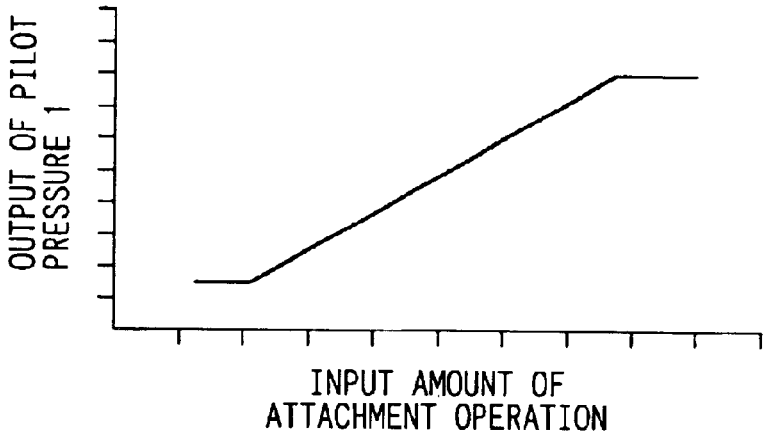
FIG. 20 is a characteristic diagram showing control characteristics to control pilot pressure output with respect to amounts of operation input to the two attachment control valves set in Table 2-6.
Figure 20:
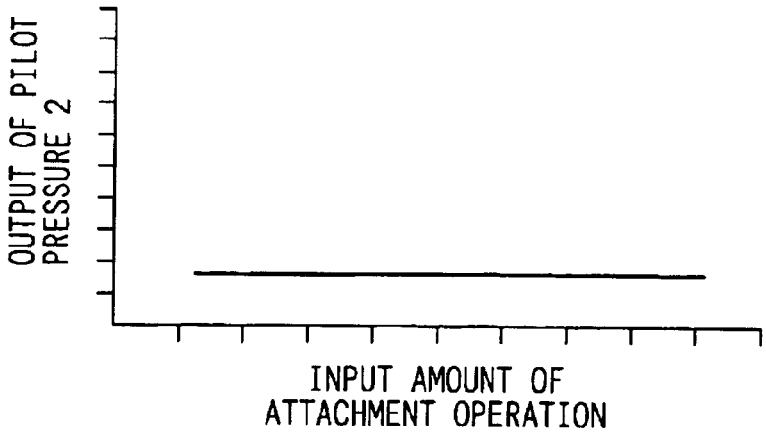

When the turning actuator 52, the bucket actuator 58, and the attachment actuator 60 are operated to work simultaneously, in other words when the attachment actuator 60 is operated when P1>0, P2=0, and P3>0 in the control pattern for giving priority to the bucket with a high priority allocated to the attachment, the right and left pilot pressures for the attachment are controlled as shown in FIGS. 20(*a*) and (*b*). To be more specific, the left pilot pressure 1 is controlled in proportion to the input amount of attachment operation according to the control characteristics set in Table 2-6, while the right pilot pressure 2 is maintained at zero so that the hydraulic pressure and flow from the right pump 13 are supplied only to the bucket actuator 58, without being used for the attachment actuator 60.

(Step 38,39)

Figure 21:
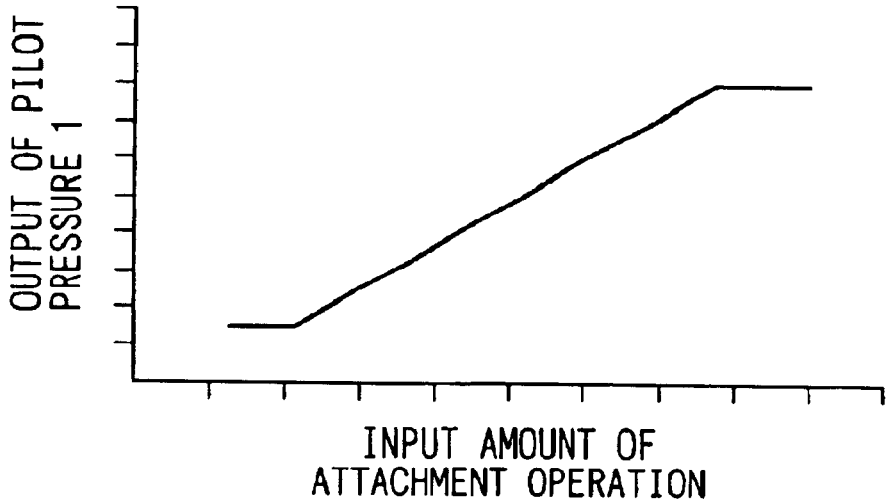
FIG. 21 is a characteristic diagram showing control characteristics to control pilot pressure output with respect to amounts of operation input to the two attachment control valves set in Table 2-7.
Figure 21:
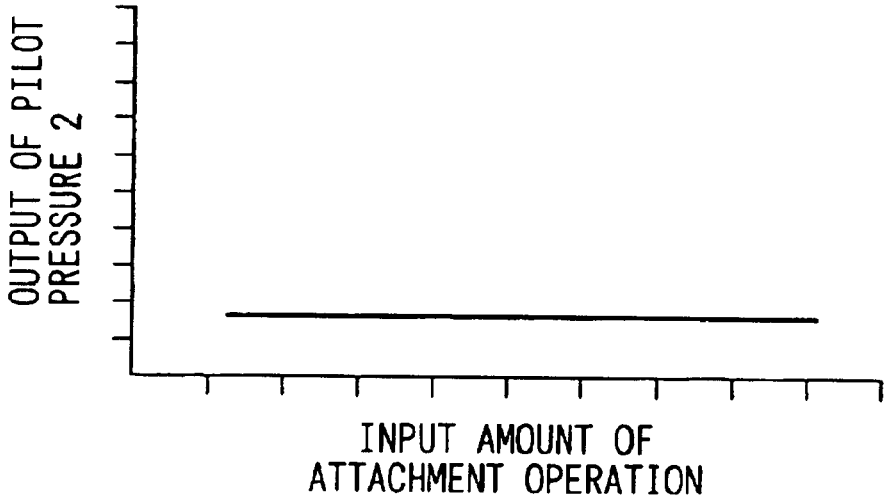

When the boom actuators 54, the bucket actuator 58, and the attachment actuator 60 are operated to work simultaneously, in other words when the attachment actuator 60 is operated when P1=0, P2>0, and P3>0 in the control pattern for giving priority to the bucket with a high priority allocated to the attachment, the right and left pilot pressures for the attachment are controlled as shown in FIGS. 21(*a*) and (*b*). To be more specific, the left pilot pressure 1 is controlled in proportion to the input amount of attachment operation according to the control characteristics set in Table 2-7, while the right pilot pressure 2 is maintained at zero so that the hydraulic oil from the right pump 13 is not used for the attachment actuator 60 and supplied to either the bucket actuator 58 or the boom actuators 54, whichever may be of lower pressure.

(Step 40)

Figure 22:
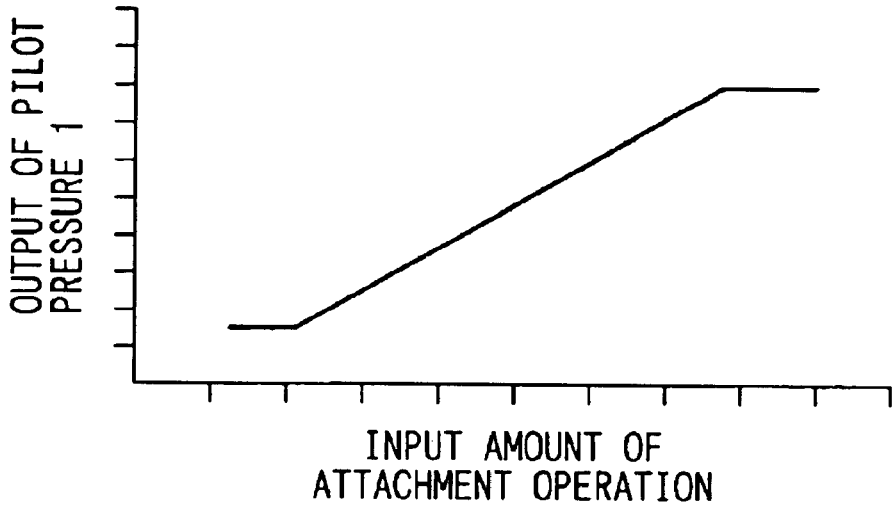
FIG. 22 is a characteristic diagram showing control characteristics to control pilot pressure output with respect to amounts of operation input to the two attachment control valves set in Table 2-8.
Figure 22:
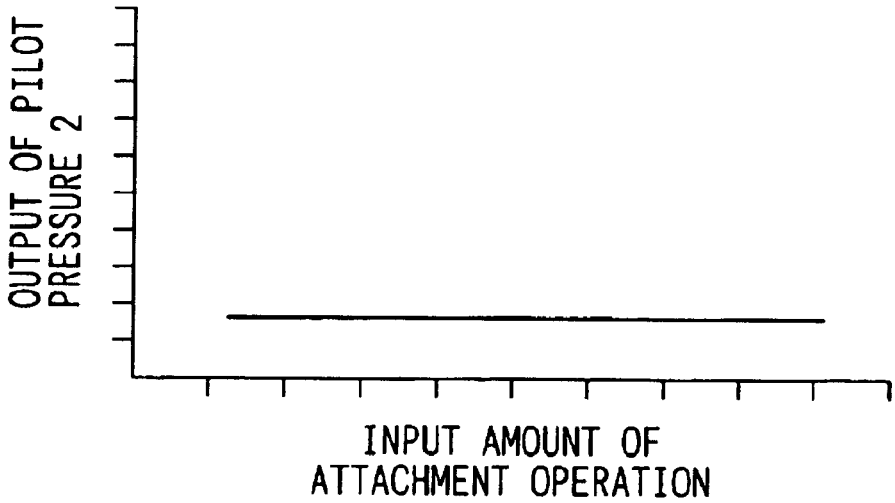

When the turning actuator 52, the boom actuators 54, the bucket actuator 58, and the attachment actuator 60 are operated to work simultaneously, in other words when the attachment actuator 60 is operated when P1>0, P2>0, and P3>0 in the control pattern for giving priority to the bucket with a high priority allocated to the attachment, the right and left pilot pressures for the attachment are controlled as shown in FIGS. 22(*a*) and (*b*). To be more specific, the left pilot pressure 1 is controlled in proportion to the input amount of attachment operation according to the control characteristics set in Table 2-8, while the right pilot pressure 2 is maintained at zero so that the hydraulic oil from the right pump 13 is not used for the attachment actuator 60 and supplied to either the bucket actuator 58 or the boom actuators 54, whichever may be of lower pressure.

(Step 8)

Figure 5:
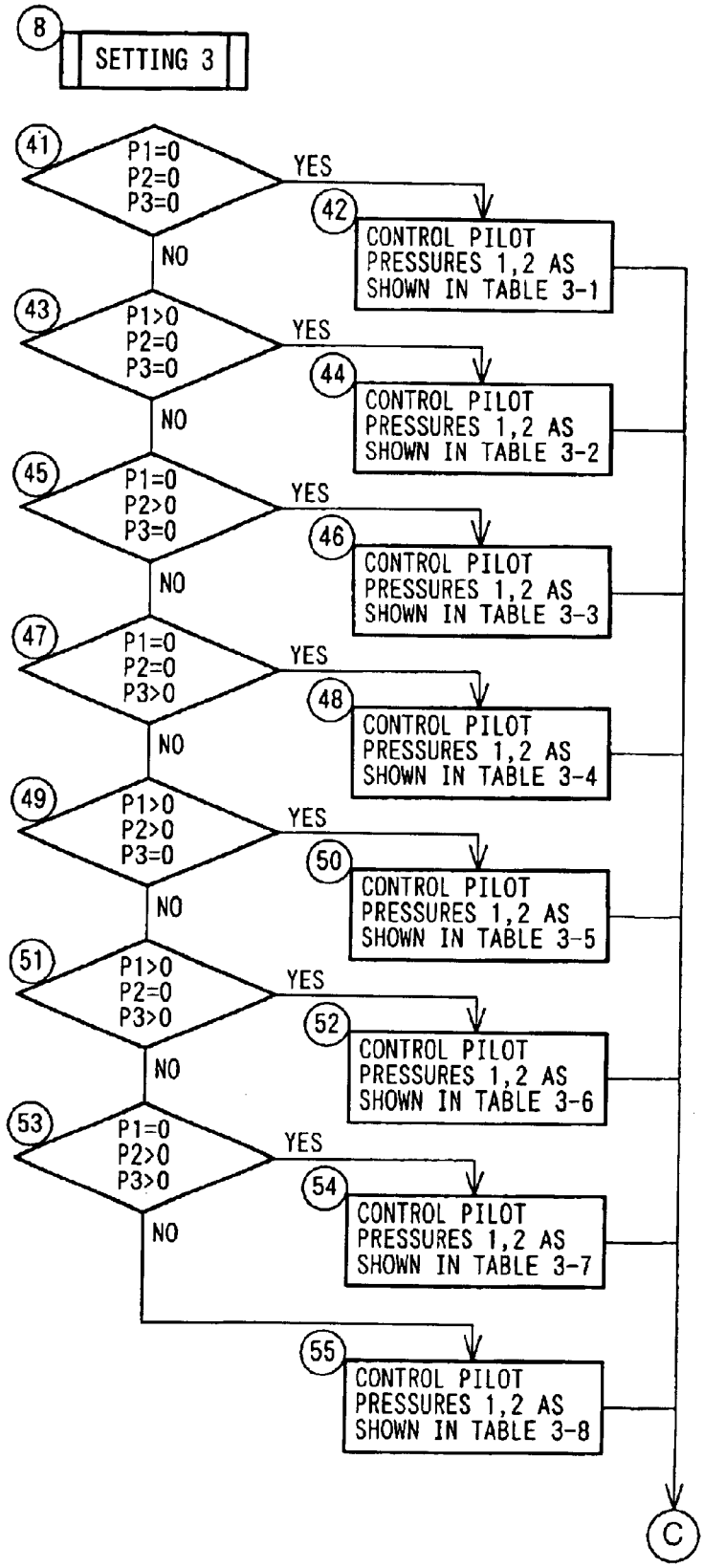
FIG. 5 is a flow chart showing Setting 3 of said process of attachment setting.

Third, referring to the flow chart shown in FIG. 5, a case where [Setting 3] for giving priority to the bucket with a low priority allocated to the attachment has been chosen in attachment setting in the flow chart shown in FIG. 2 ("Yes" in Step 7) is explained hereunder.

(Step 41,42)

Figure 23:
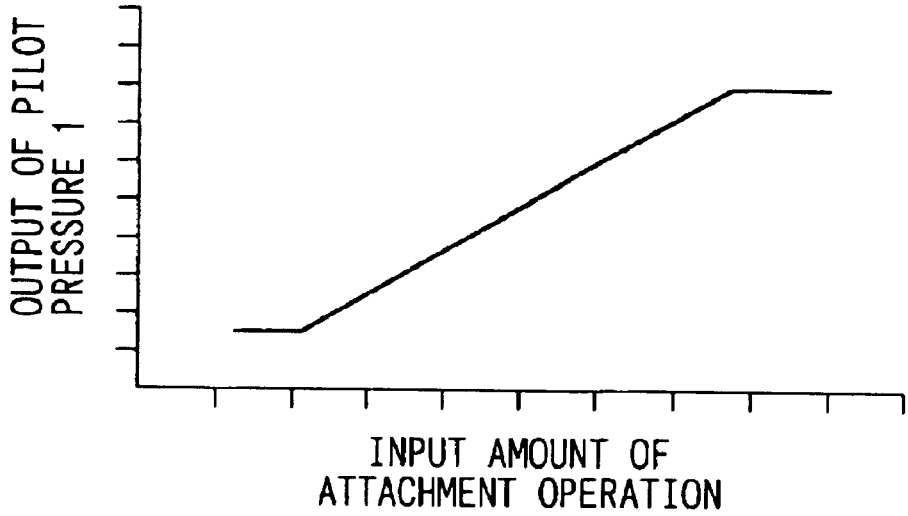
FIG. 23 is a characteristic diagram showing control characteristics to control pilot pressure output with respect to amounts of operation input to the two attachment control valves set in Table 3-1.
Figure 23:
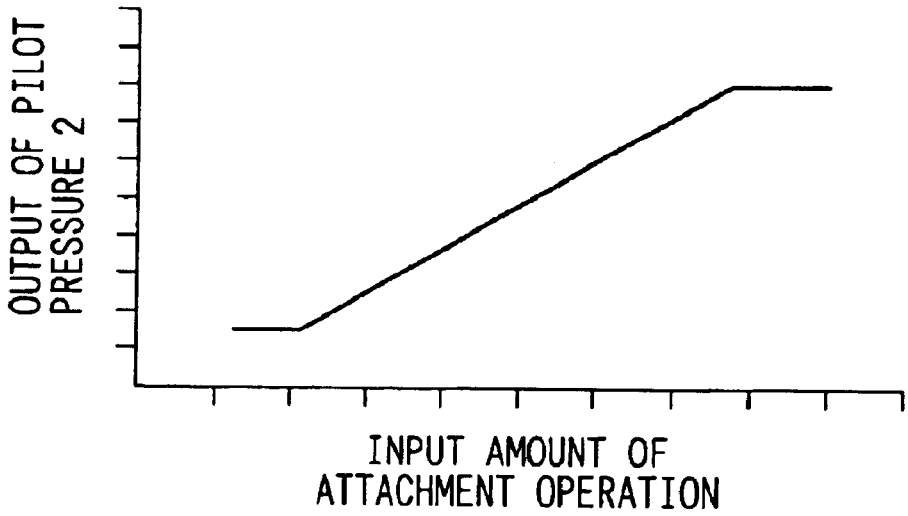

When the attachment actuator 60 is operated to work in the single operation mode, in other words when the attachment actuator 60 is operated when P1=P2=P3=0 in the control pattern for giving priority to the bucket with a low priority allocated to the attachment, the right and left pilot pressures for the attachment are controlled, as shown in FIGS. 23(*a*) and (*b*), in proportion to the input amount of attachment operation according to the control characteristics set in Table 3-1.

(Step 43,44)

Figure 24:
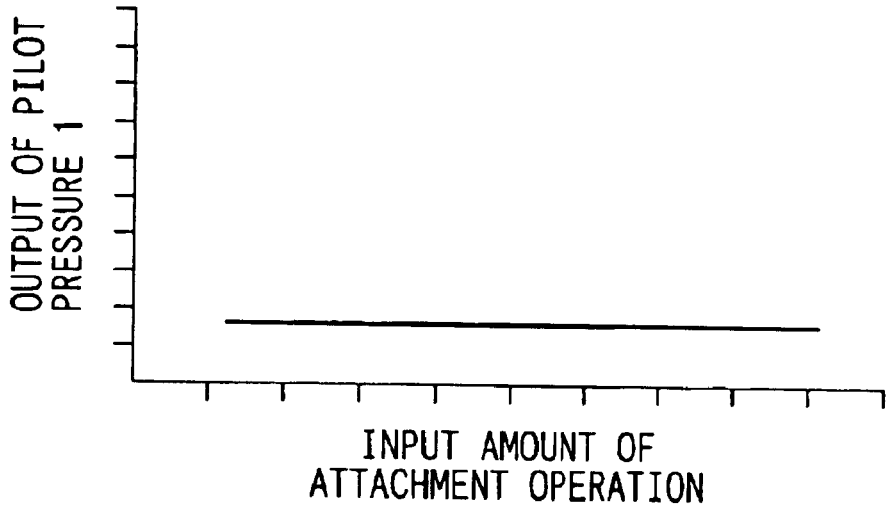
FIG. 24 is a characteristic diagram showing control characteristics to control pilot pressure output with respect to amounts of operation input to the two attachment control valves set in Table 3-2.
Figure 24:
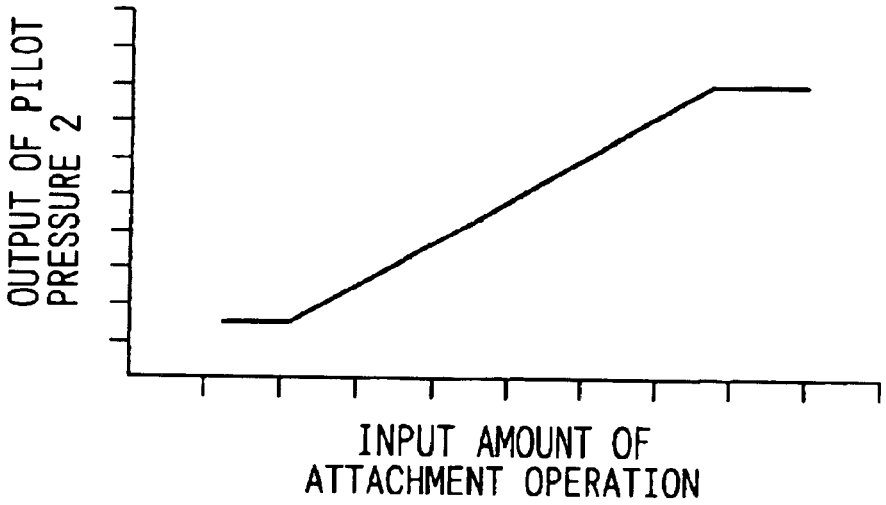

When the attachment actuator 60 is operated to work simultaneously with the turning actuator 52, in other words when the attachment actuator 60 is operated when P1>0 and P2=P3=0 in the control pattern for giving priority to the bucket with a low priority allocated to the attachment, the right and left pilot pressures for the attachment are controlled as shown in FIGS. 24(*a*) and (*b*). To be more specific, the right pilot pressure 2 is controlled in proportion to the input amount of attachment operation according to the control characteristics set in Table 3-2, while the left pilot pressure 1 is maintained at zero so that the hydraulic pressure and flow from the left pump 12 are supplied only to the turning actuator 52, without being used for the attachment actuator 60.

(Step 45,46)

When the attachment actuator 60 is operated to work simultaneously with the boom actuators 54, in other words when the attachment actuator 60 is operated when P1=0, P2>0, and P3=0 in the control pattern for giving priority to the bucket with a low priority allocated to the attachment, the right and left pilot pressures for the attachment are controlled as shown in FIGS. 25(*a*) and (*b*). To be more specific, the left pilot pressure 1 is controlled in proportion to the input amount of attachment operation according to the control characteristics set in Table 3-3, with the hydraulic oil fed from the left pump 12 to the attachment actuator 60 maintained at a relatively low pressure and flow rate by reducing the proportional gain of the pilot pressure compared with when allocating a high priority to the attachment. Meanwhile, the right pilot pressure 2 is maintained at zero so that the hydraulic pressure and flow from the right pump 13 are supplied only to the boom actuators 54, without being used for the attachment actuator 60.

(Step 47,48)

Figure 26:
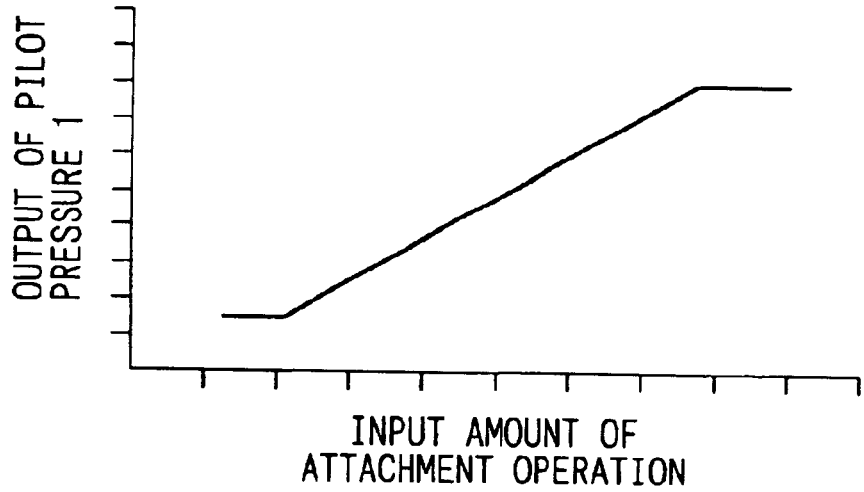
FIG. 26 is a characteristic diagram showing control characteristics to control pilot pressure output with respect to amounts of operation input to the two attachment control valves set in Table 3-4.
Figure 26:
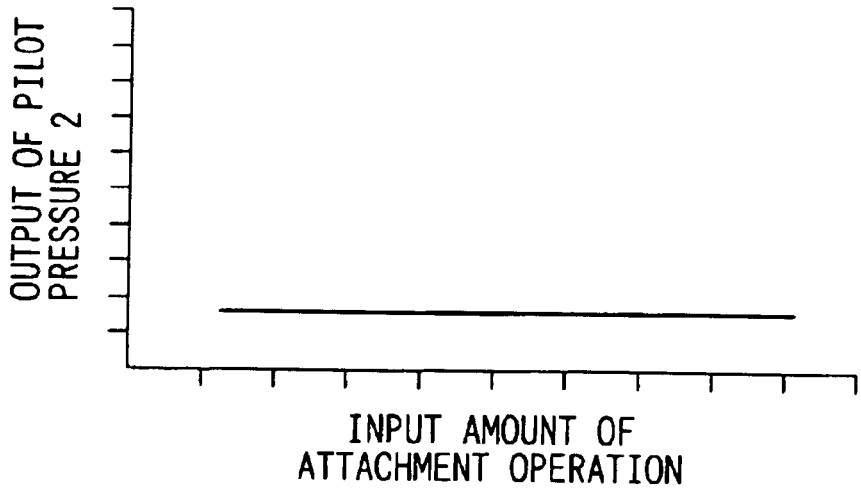

When the attachment actuator 60 is operated to work simultaneously with the bucket actuator 58, in other words when the attachment actuator 60 is operated when P1=P2=0 and P3>0 in the control pattern for giving priority to the bucket with a low priority allocated to the attachment, the right and left pilot pressures for the attachment are controlled as shown in FIGS. 26(*a*) and (*b*). To be more specific, the left pilot pressure 1 is controlled in proportion to the input amount of attachment operation according to the control characteristics set in Table 3-4, while the right pilot pressure 2 is maintained at zero so that the hydraulic pressure and flow from the right pump 13 are supplied only to the bucket actuator 58, without being used for the attachment actuator 60.

(Step 49,50)

When the turning actuator 52, the boom actuators 54, and the attachment actuator 60 are operated to work simultaneously, in other words when the attachment actuator 60 is operated when P1>0, P2>0, and P3=0 in the control pattern for giving priority to the bucket with a low priority allocated to the attachment, the right and left pilot pressures for the attachment are controlled as shown in FIGS. 27(*a*) and (*b*). To be more specific, the right pilot pressure 2 is controlled in proportion to the input amount of attachment operation according to the control characteristics set in Table 3-5, with the hydraulic oil fed from the right pump 13 to the attachment actuator 60 maintained at a relatively low pressure and flow rate by reducing the proportional gain of the pilot pressure compared with when allocating a high priority to the attachment. Meanwhile, the left pilot pressure 1 is maintained at zero so that the hydraulic oil from the left pump 12 is not used for the attachment actuator 60 and supplied to either the turning actuator 52 or the boom actuators 54, whichever may be of lower pressure.

(Step 51,52)

When the turning actuator 52, the bucket actuator 58, and the attachment actuator 60 are operated to work simultaneously, in other words when the attachment actuator 60 is operated when P1>0, P2=0, and P3>0 in the control pattern for giving priority to the bucket with a low priority allocated to the attachment, the right and left pilot pressures for the attachment are controlled as shown in FIGS. 28(*a*) and (*b*). To be more specific, the left pilot pressure 1 is controlled in proportion to the input amount of attachment operation according to the control characteristics set in Table 3-6, with the hydraulic oil fed from the left pump 12 to the attachment actuator 60 maintained at a relatively low pressure and flow rate by reducing the proportional gain of the pilot pressure compared with when allocating a high priority to the attachment. Meanwhile, the right pilot pressure 2 is maintained at zero so that the hydraulic pressure and flow from the right pump 13 are supplied only to the bucket actuator 58, without being used for the attachment actuator 60.

(Step 53,54)

When the boom actuators 54, the bucket actuator 58, and the attachment actuator 60 are operated to work simultaneously, in other words when the attachment actuator 60 is operated when P1=0, P2>0, and P3>0 in the control pattern for giving priority to the bucket with a low priority allocated to the attachment, the right and left pilot pressures for the attachment are controlled as shown in FIGS. 29(*a*) and (*b*). To be more specific, the left pilot pressure 1 is controlled in proportion to the input amount of attachment operation according to the control characteristics set in Table 3-7, with the hydraulic oil fed from the left pump 12 to the attachment actuator 60 maintained at a relatively low pressure and flow rate by reducing the proportional gain of the pilot pressure compared with when allocating a high priority to the attachment. Meanwhile, the right pilot pressure 2 is maintained at zero so that the hydraulic oil from the right pump 13 is not used for the attachment actuator 60 and supplied to either the bucket actuator 58 or the boom actuators 54, whichever may be of lower pressure.

(Step 55)

When the turning actuator 52, the boom actuators 54, the bucket actuator 58, and the attachment actuator 60 are operated to work simultaneously, in other words when the attachment actuator 60 is operated when P1>0, P2>0, and P3>0 in the control pattern for giving priority to the bucket with a low priority allocated to the attachment, the right and left pilot pressures for the attachment are controlled as shown in FIGS. 30(*a*) and (*b*). To be more specific, the left pilot pressure 1 is controlled in proportion to the input amount of attachment operation according to the control characteristics set in Table 3-8, with the hydraulic oil fed from the left pump 12 to the attachment actuator 60 maintained at a relatively low pressure and flow rate by reducing the proportional gain of the pilot pressure compared with when allocating a high priority to the attachment. Meanwhile, the right pilot pressure 2 is maintained at zero so that the hydraulic oil from the right pump 13 is not used for the attachment actuator 60 and supplied to either the bucket actuator 58 or the boom actuators 54, whichever may be of lower pressure.

(Step 10)

Figure 6:
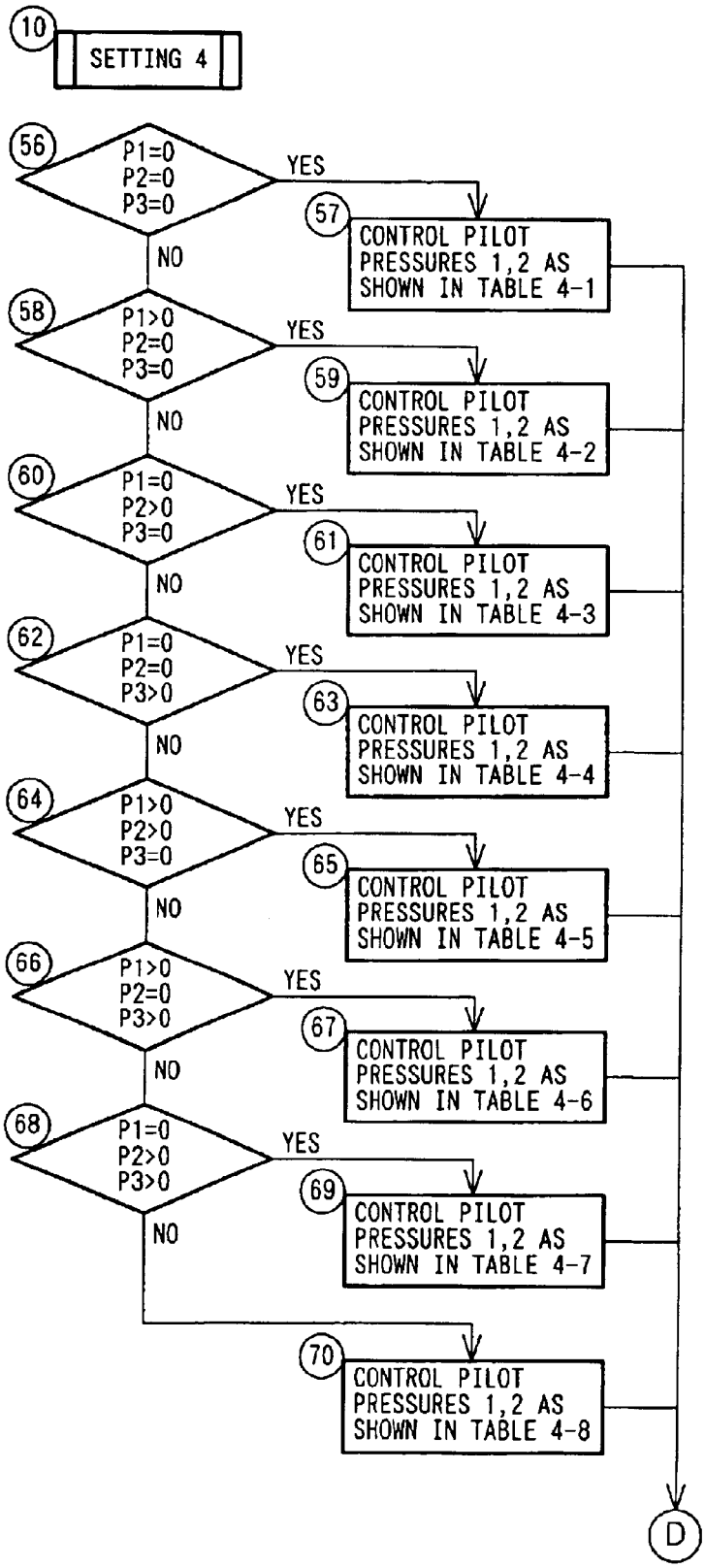
FIG. 6 is a flow chart showing Setting 4 of said process of attachment setting.

Fourth, referring to the flow chart shown in FIG. 6, a case where [Setting 4] for giving priority to combined operatability has been chosen in attachment setting in the flow chart shown in FIG. 2 ("Yes" in Step 9) is explained hereunder.

(Step 56,57)

Figure 31:
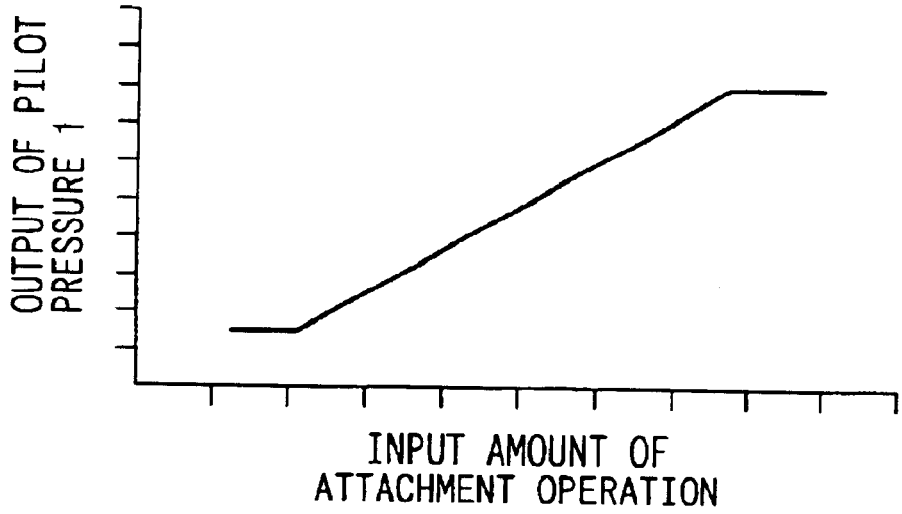
FIG. 31 is a characteristic diagram showing control characteristics to control pilot pressure output with respect to amounts of operation input to the two attachment control valves set in Table 4-1.
Figure 31:
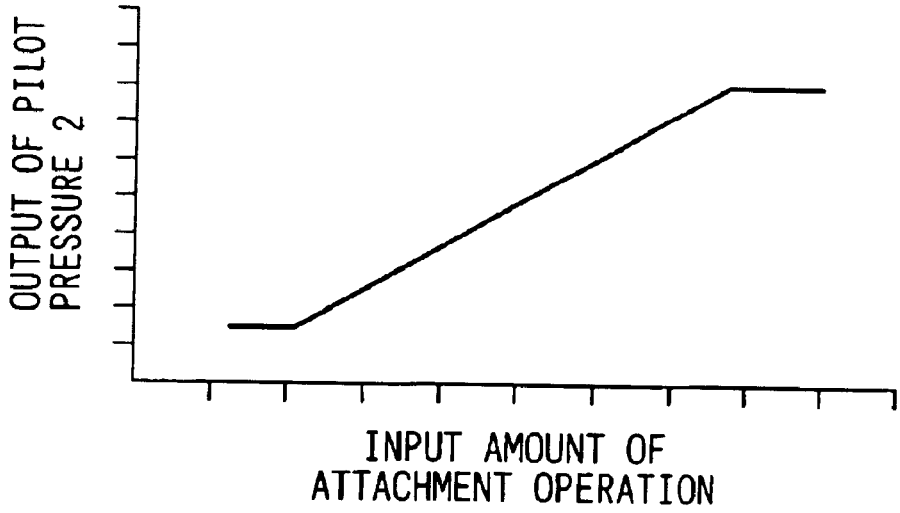

When the attachment actuator 60 is operated to work in the single operation mode, in other words when the attachment actuator 60 is operated when P1=P2=P3=0 in the control pattern for giving priority to combined operatability, the right and left pilot pressures for the attachment are controlled, as shown in FIGS. 31(*a*) and (*b*), in proportion to the input amount of attachment operation according to the control characteristics set in Table 4-1.

(Step 58,59)

Figure 32:
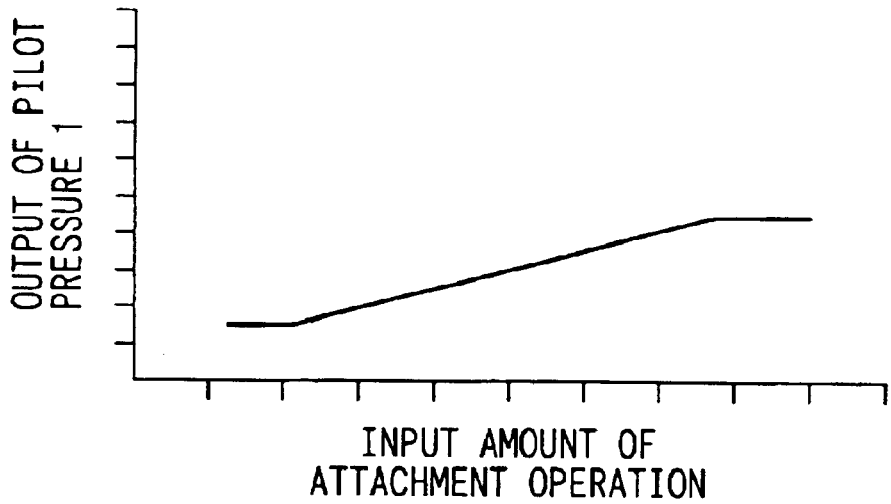
FIG. 32 is a characteristic diagram showing control characteristics to control pilot pressure output with respect to amounts of operation input to the two attachment control valves set in Table 4-2.
Figure 32:
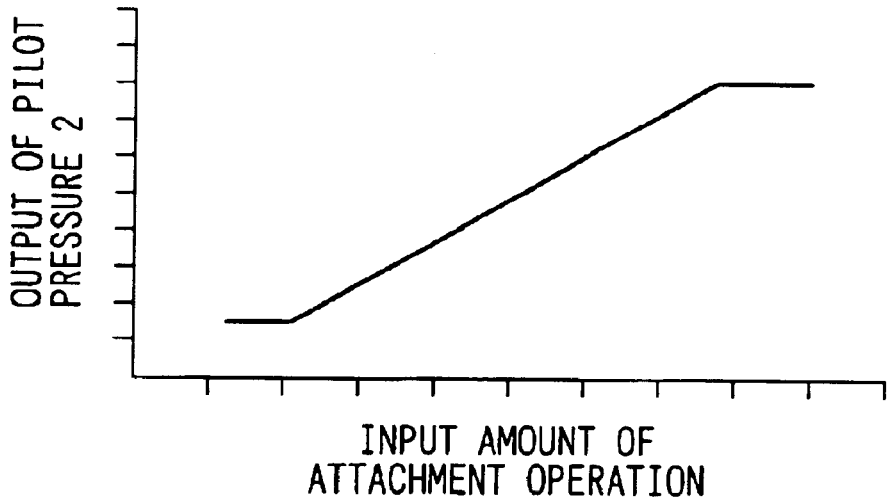

When the attachment actuator 60 is operated to work simultaneously with the turning actuator 52, in other words when the attachment actuator 60 is operated when P1>0 and P2=P3=0 in the control pattern for giving priority to combined operatability, the right and left pilot pressures 1,2 for the attachment are controlled as shown in FIGS. 32(*a*) and (*b*), in proportion to the input amount of attachment operation according to the control characteristics set in Table 4-2. At that time, the proportional gain of the left pilot pressure 1 is controlled to be lower than that of the right pilot pressure 2 so that the hydraulic oil fed from the left pump 12 to the attachment actuator 60 is maintained at a pressure and flow rate that is somewhat lower than the pressure and the flow rate of the hydraulic oil fed from the right pump 13 to the attachment actuator 60.

(Step 60,61)

Figure 33:
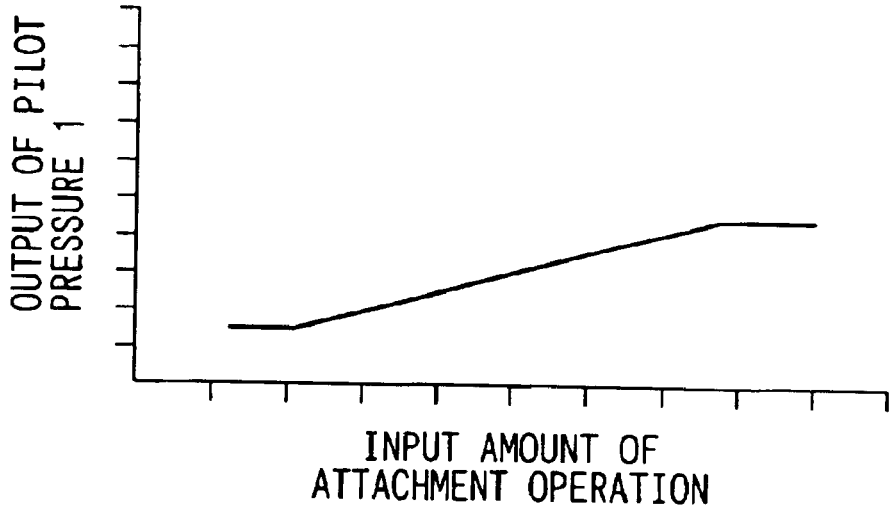
FIG. 33 is a characteristic diagram showing control characteristics to control pilot pressure output with respect to amounts of operation input to the two attachment control valves set in Table 4-3.
Figure 33:
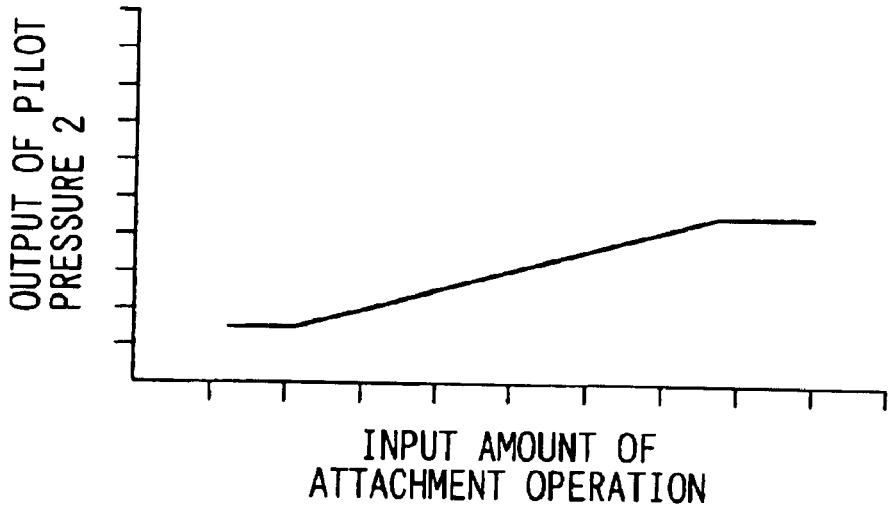

When the attachment actuator 60 is operated to work simultaneously with the boom actuators 54, in other words when the attachment actuator 60 is operated when P1=0, P2>0, and P3=0 in the control pattern for giving priority to combined operatability, the right and left pilot pressures 1,2 for the attachment are controlled as shown in FIGS. 33(*a*) and (*b*), in proportion to the input amount of attachment operation according to the control characteristics set in Table 4-3. At that time, the proportional gains of the pilot pressures are reduced compared with when operating the attachment alone so that the hydraulic oil fed from the left pump 12 and the right pump 13 to the attachment actuator 60 is maintained at relatively low pressures and flow rates.

(Step 62,63)

Figure 34:
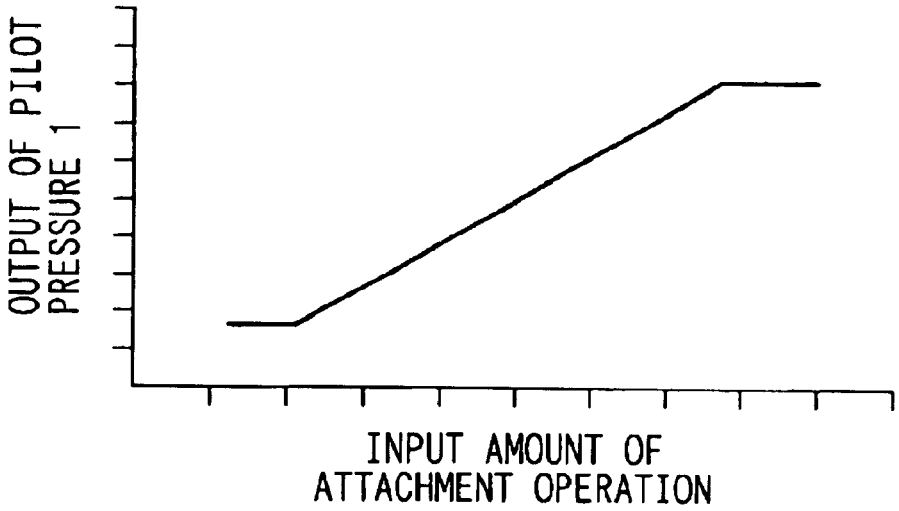
FIG. 34 is a characteristic diagram showing control characteristics to control pilot pressure output with respect to amounts of operation input to the two attachment control valves set in Table 4-4.
Figure 34:
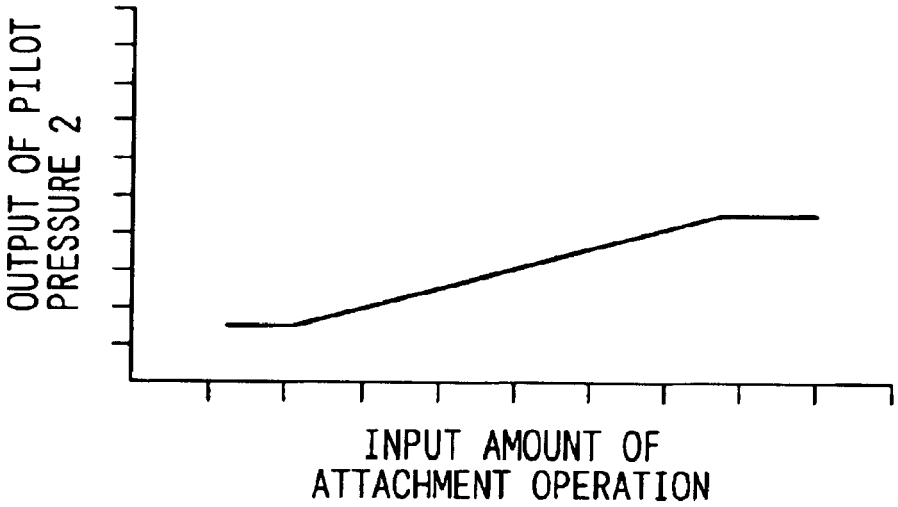

When the attachment actuator 60 is operated to work simultaneously with the bucket actuator 58, in other words when the attachment actuator 60 is operated when P1=P2=0 and P3>0 in the control pattern for giving priority to combined operatability, the right and left pilot pressures 1,2 for the attachment are controlled as shown in FIGS. 34(*a*) and (*b*), in proportion to the input amount of attachment operation according to the control characteristics set in Table 4-4. At that time, the proportional gain of the right pilot pressure 2 is controlled to be lower than that of the left pilot pressure 1 so that the hydraulic oil fed from the right pump 13 to the attachment actuator 60 is maintained at a pressure and flow rate that is somewhat lower than the pressure and the flow rate of the hydraulic oil fed from the left pump 12 to the attachment actuator 60.

(Step 64,65)

Figure 35:
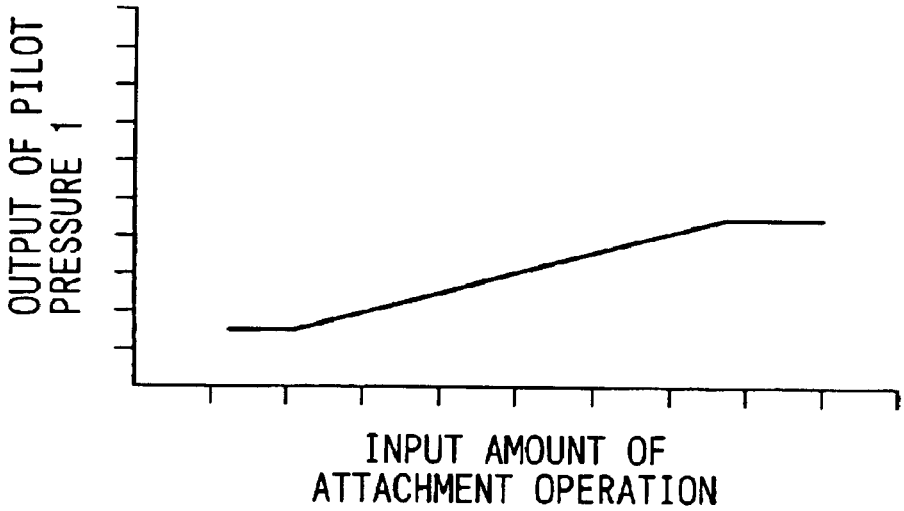
FIG. 35 is a characteristic diagram showing control characteristics to control pilot pressure output with respect to amounts of operation input to the two attachment control valves set in Table 4-5.
Figure 35:
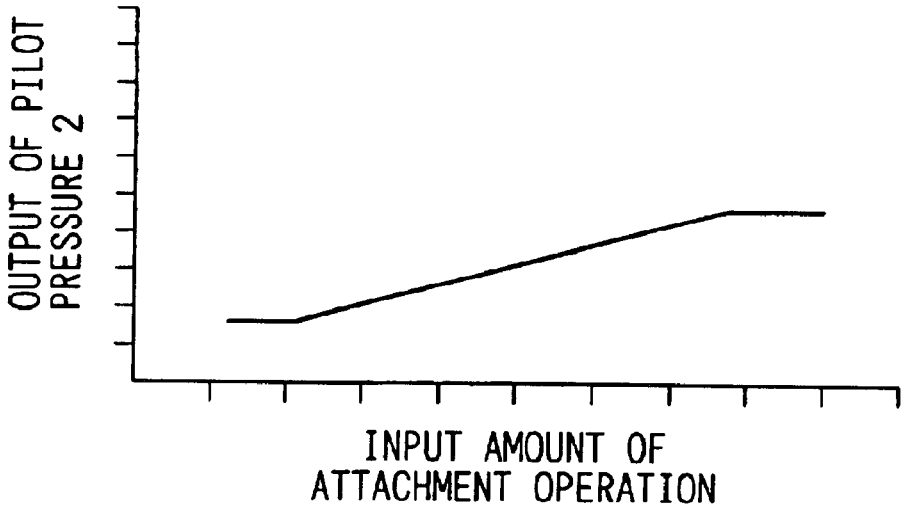

When the turning actuator 52, the boom actuators 54, and the attachment actuator 60 are operated to work simultaneously, in other words when the attachment actuator 60 is operated when P1>0, P2>0, and P3=0 in the control pattern for giving priority to combined operatability, the right and left pilot pressures 1,2 for the attachment are controlled as shown in FIGS. 35(*a*) and (*b*), in proportion to the input amount of attachment operation according to the control characteristics set in Table 4-5. At that time, the proportional gains of the pilot pressures are reduced compared with when operating the attachment alone so that the hydraulic oil fed from the left pump 12 and the right pump 13 to the attachment actuator 60 is maintained at relatively low pressures and flow rates.

(Step 66,67)

Figure 36:
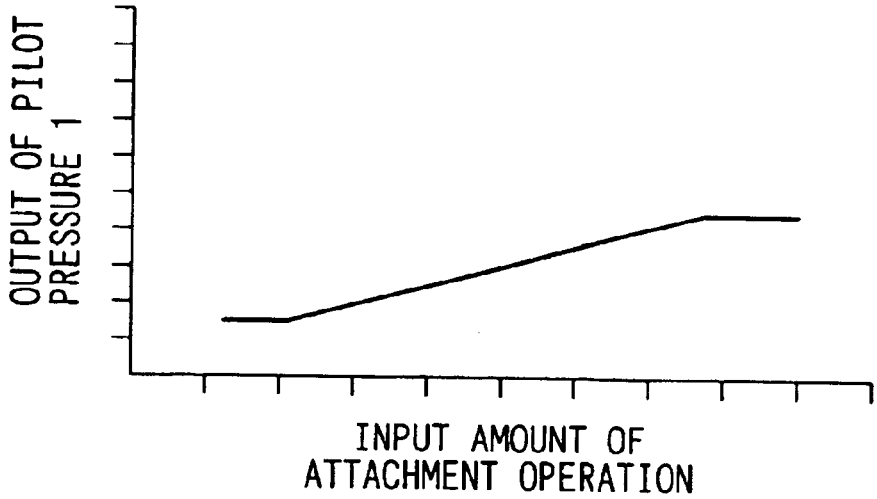
FIG. 36 is a characteristic diagram showing control characteristics to control pilot pressure output with respect to amounts of operation input to the two attachment control valves set in Table 4-6.
Figure 36:
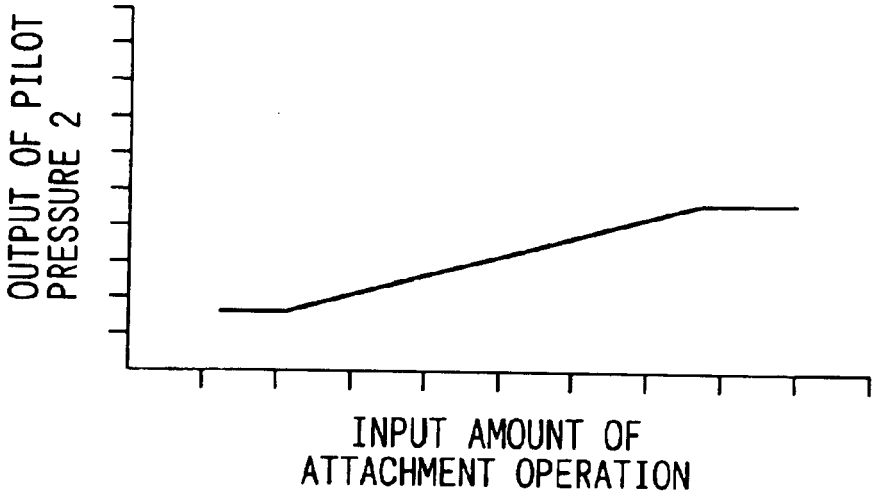

When the turning actuator 52, the bucket actuator 58, and the attachment actuator 60 are operated to work simultaneously, in other words when the attachment actuator 60 is operated when P1>0, P2=0, and P3>0 in the control pattern for giving priority to combined operatability, the right and left pilot pressures 1,2 for the attachment are controlled as shown in FIGS. 36(*a*) and (*b*), in proportion to the input amount of attachment operation according to the control characteristics set in Table 4-6. At that time, the proportional gains of the pilot pressures are reduced compared with when operating the attachment alone so that the hydraulic oil fed from the left pump 12 and the right pump 13 to the attachment actuator 60 is maintained at relatively low pressures and flow rates.

(Step 68,69)

Figure 37:
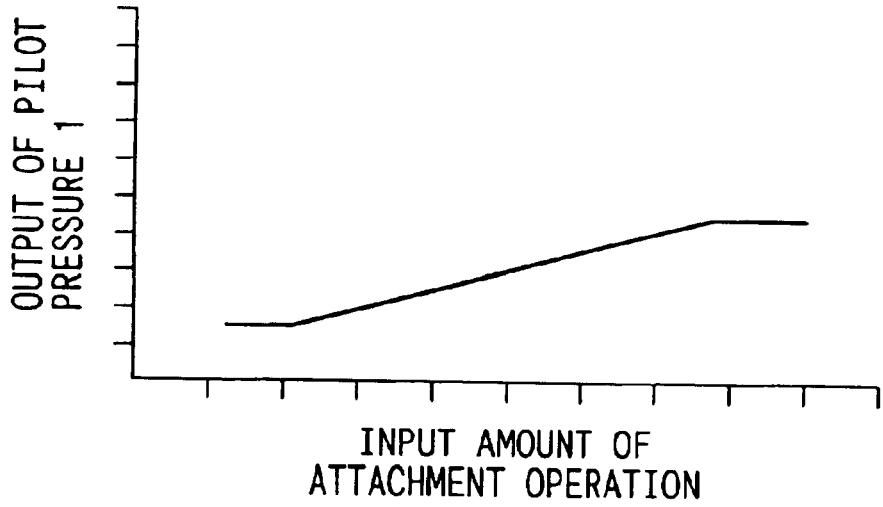
FIG. 37 is a characteristic diagram showing control characteristics to control pilot pressure output with respect to amounts of operation input to the two attachment control valves set in Table 4-7.
Figure 37:
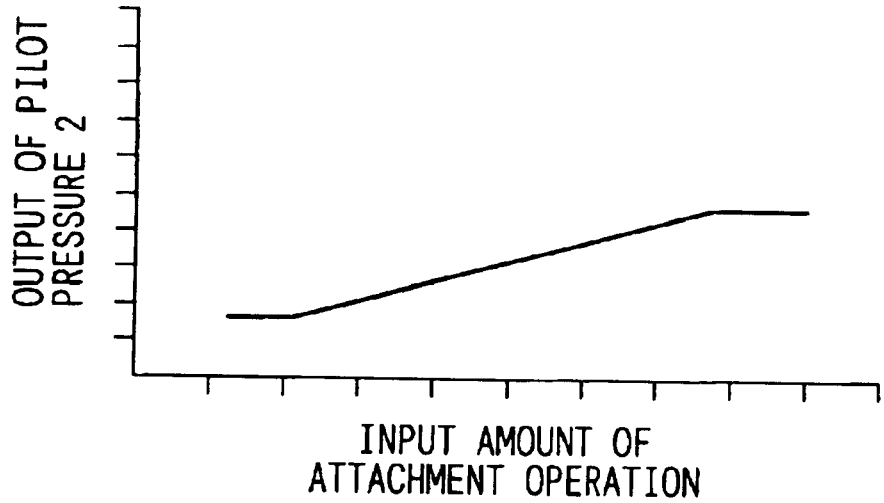

When the boom actuators 54, the bucket actuator 58, and the attachment actuator 60 are operated to work simultaneously, in other words when the attachment actuator 60 is operated when P1=0, P2>0, and P3>0 in the control pattern for giving priority to combined operatability, the right and left pilot pressures 1,2 for the attachment are controlled as shown in FIGS. 37(*a*) and (*b*), in proportion to the input amount of attachment operation according to the control characteristics set in Table 4-7. At that time, the proportional gains of the pilot pressures are reduced compared with when operating the attachment alone so that the hydraulic oil fed from the left pump 12 and the right pump 13 to the attachment actuator 60 is maintained at relatively low pressures and flow rates.

(Step 70)

Figure 38:
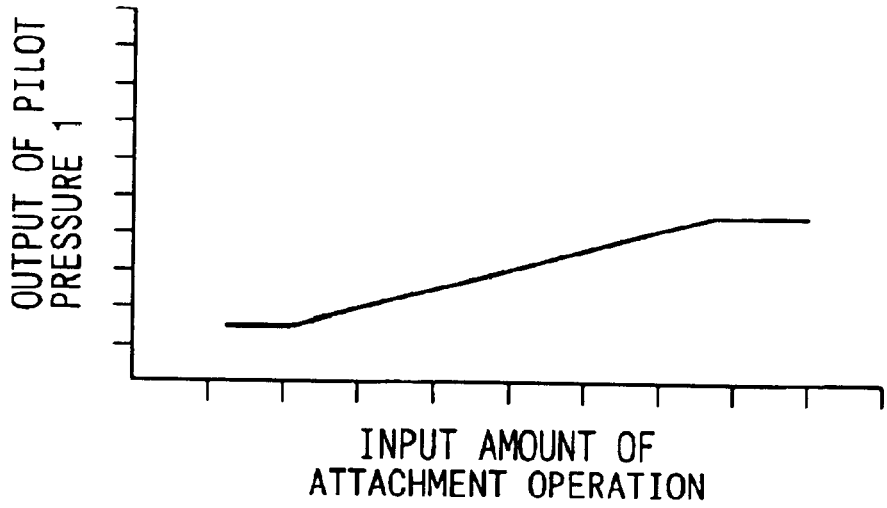
FIG. 38 is a characteristic diagram showing control characteristics to control pilot pressure output with respect to amounts of operation input to the two attachment control valves set in Table 4-8.
Figure 38:
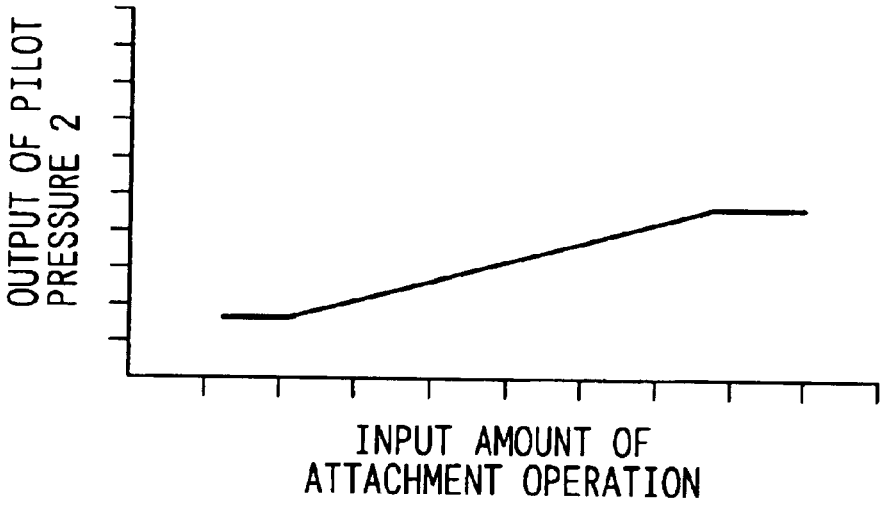
Figure 39:
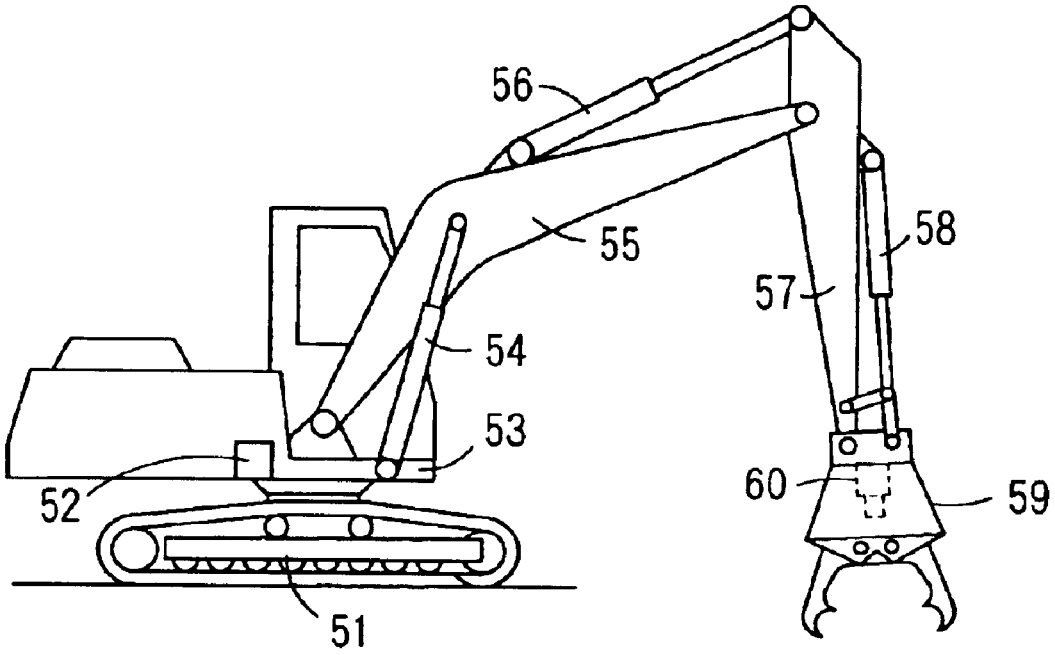
FIG. 39 is a schematic illustration of a hydraulic excavator with an attachment mounted thereon.

When the turning actuator 52, the boom actuators 54, the bucket actuator 58, and the attachment actuator 60 are operated to work simultaneously, in other words when the attachment actuator 60 is operated when P1>0, P2>0, and P3>0 in the control pattern for giving priority to combined operatability, the right and left pilot pressures 1,2 for the attachment are controlled as shown in FIGS. 38(*a*) and (*b*), in proportion to the input amount of attachment operation according to the control characteristics set in Table 4-8. At that time, the proportional gains of the pilot pressures are reduced compared with when operating the attachment alone so that the hydraulic oil fed from the left pump 12 and the right pump 13 to the attachment actuator 60 is maintained at relatively low pressures and flow rates.

As described above, a hydraulic circuit according to the present invention gives a priority to supply of hydraulic oil to the turning actuator 52 (turning-priority mode) when the attachment 59 is an open/close breaker or any other tool of an open/close type that is often used while the upper structure 53 is rotated. In cases where the attachment 59 is a breaker or any other similar tool that may be subject to adjustment of the angle of its impact by the bucket actuator 58 in the course of operation, a setting for giving priority to the bucket, i.e. bucket-priority mode with a high priority allocated to the attachment, is suitable. When the attachment 59 is heavy and therefore will cause a heavy load to be applied to the boom actuators 54 or the like, combined operation with other actuators, such as the boom actuators 54, can be optimized by selecting a setting that calls for reducing the priority to the attachment, in other words the setting for giving priority to the bucket with a low priority allocated to the attachment. When operating the attachment actuator 60 simultaneously with the actuators 54 and/or the actuator 56, which use hydraulic oil from both pumps, the operatability of the attachment 59 can be improved by selecting the setting for giving priority to combined operatability, i.e. the setting that calls for operating the attachment actuator 60 constantly at a two-pump confluent flow rate so as to prevent sudden change in the operation speed of the attachment 59.

Because of the capability of storing in the memory a plurality of control patterns for controlling the attachment actuator 60 and choosing one from among the stored control patterns when changing to another attachment, the controller 43 eliminates the complication of readjusting the setting each time the attachment is changed.

Because of the capability of changing the control characteristics stored in the memory, the controller 43 is capable of optimizing the control characteristics for any other attachment introduced later.

Furthermore, a hydraulic circuit according to the present invention offers both a satisfactory maximum working speed of the attachment actuator 60 in the single operation mode and a satisfactory operatability in combined operation with any other actuators 52,54,56,56,58.

In demolition or other work that must be performed while changing a plurality of attachments, there is no need of setting or adjusting the hydraulic circuit by individually adjusting various control characteristics, such as circuit configurations or pressure settings, each time the attachment is changed; a plurality of control characteristics can be set collectively by preparing a plurality of control patterns beforehand by grouping a plurality of control conditions and choosing one from among these control patters. Therefore, the invention facilitates adjusting operation performed when changing the attachment.

Another benefit of the invention lies in the capability of optimizing the control of the hydraulic circuit for some other attachment actuator 60 at any desired time by overwriting the control characteristics.

According to the embodiment shown in FIG. 1, the pilot operated control valves 21 through 28 are controlled by a hydraulic pilot system. However, a control system according to the invention can also be used to control solenoid operated control valves that are adapted to be operated by electric signals.

If such is the case, there is no need of providing the pilot pressure control hydraulic circuits 31,33,35,37 or the pilot pressure sensors 32,34,36,38, because the controller 43 is capable of processing electric signals input from an electric joystick or the like and directly controlling the solenoid operated control valves by outputting electric signals.

POSSIBLE INDUSTRIAL APPLICATION

The use of a control system according to the invention is not limited to a hydraulic circuit of a hydraulic excavator; it is also applicable to a hydraulic circuit of any other work machine that operates a plurality of hydraulic actuators simultaneously.

What is claimed is:

1. A hydraulic circuit control system comprising:

two pumps;

specific control valves corresponding to said pumps for controlling hydraulic fluid supplied from said pumps to a specific actuator;

a plurality of other control valves respectively corresponding to said pumps for controlling hydraulic fluid supplied from said pumps to one or more other actuators;

discriminating means for distinguishing between control conditions for operating each said specific actuator alone and control conditions for operating the same simultaneously with any of the other actuators;

a controller for controlling control characteristics of the specific control valves based on discriminated control conditions having functions of storing control characteristics for each respective control valve and choosing the characteristics most suitable for the control conditions from among a plurality of control characteristics stored therein, and having a function that when ascertaining combined operation of the specific actuator with any of the other actuators, the controller automatically adjusts control signals to be output to the two specific control valves so as to switch the source of hydraulic fluid to the specific actuator from the two pumps to either one of the two pumps according to pump-selecting criteria for the combined operation mode, which criteria have been set beforehand with respect to the other actuators.

2. A hydraulic circuit control system as claimed in claim 1, wherein: the controller has a function of storing a plurality of control patterns consisting of a plurality of grouped control characteristics of the specific control valves; and the hydraulic circuit control system includes a control pattern selecting device for selecting from these control patterns the pattern most appropriate for the specific actuator.

3. A hydraulic circuit control system as claimed in claim 2, wherein:

the controller is provided with a control pattern that includes such control characteristics as to reduce the output signal ratio with respect to the amount of operation to be input into the specific control valves when the controller ascertains combined operation and a great load being applied to the other actuators.

4. A hydraulic circuit control system as claimed in claim 1, wherein:

the controller is provided with a control characteristic overwriting device adapted to overwrite control characteristics currently stored in the controller with other control characteristics that correspond to some other specific actuator.

5. hydraulic circuit control system as claimed in claim 1 wherein:

the specific actuator is an attachment actuator for operating the attachment attached to the fore end of the working device of a hydraulic excavator; and the other actuators are working actuators other than the attachment actuator.

6. A hydraulic circuit control system as claimed in claim 5, wherein:

the controller is capable of storing a plurality of control patterns consisting of a plurality of control characteristics of the specific control valves, which characteristics are grouped in accordance with a plurality of attachments that can be interchangeably attached to the same working device; and the controller is provided with a control pattern selecting device for choosing, when the attachment is changed, a pattern appropriate for the actuator of the newly connected attachment from among these control patterns.

* * * * *